US008350788B1

(12) United States Patent
Nearman et al.

(10) Patent No.: US 8,350,788 B1
(45) Date of Patent: Jan. 8, 2013

(54) LOUVER PANEL FOR AN ELECTRONIC SIGN

(75) Inventors: Nathan L. Nearman, Brookings, SD (US); Brett D. Wendler, Watertown, SD (US); Eric S. Bravek, Brookings, SD (US); Chad N. Gloege, Brookings, SD (US); Matthew R. Mueller, Brookings, SD (US); Jason N. Harms, Brookings, SD (US)

(73) Assignee: Daktronics, Inc., Brookings, SD (US)

( * ) Notice: Subject to any disclaimer, the term of this patent is extended or adjusted under 35 U.S.C. 154(b) by 901 days.

(21) Appl. No.: 12/217,003

(22) Filed: Jul. 1, 2008

Related U.S. Application Data

(60) Provisional application No. 60/958,509, filed on Jul. 6, 2007.

(51) Int. Cl.
*G09G 3/32* (2006.01)

(52) U.S. Cl. ..... 345/83; 345/82; 345/39; 345/40; 345/44; 40/541; 40/542; 40/554; 315/169.3

(58) Field of Classification Search ..... 345/76–83, 345/44–46, 204, 903, 39–40, 48; 315/169.3; 40/542–607.15
See application file for complete search history.

(56) References Cited

U.S. PATENT DOCUMENTS

| | | | | |
|---|---|---|---|---|
| 3,291,975 | A | | 12/1966 | Mccullough et al. |
| 3,594,761 | A | | 7/1971 | Boesen |
| 4,234,914 | A | | 11/1980 | Boesen |
| 4,659,876 | A | | 4/1987 | Sullivan et al. |
| 5,020,253 | A | | 6/1991 | Lie et al. |
| 5,027,112 | A | * | 6/1991 | Ross et al. ..... 345/56 |
| 5,132,674 | A | | 7/1992 | Bottorf |
| 5,184,116 | A | | 2/1993 | Daugherty et al. |
| 5,198,723 | A | | 3/1993 | Parker |
| 5,268,828 | A | * | 12/1993 | Miura ..... 362/249.06 |
| 5,321,417 | A | | 6/1994 | Voelzke et al. |
| 5,353,536 | A | | 10/1994 | Erber et al. |
| 5,410,328 | A | * | 4/1995 | Yoksza et al. ..... 345/82 |
| 5,559,529 | A | | 9/1996 | Maher |
| 5,617,657 | A | | 4/1997 | Kahn |
| 5,743,610 | A | | 4/1998 | Yajima et al. |
| 5,759,044 | A | | 6/1998 | Redmond |

(Continued)

FOREIGN PATENT DOCUMENTS

EP 1202162 A1 5/2002

(Continued)

OTHER PUBLICATIONS

"European Application No. 08742865.2, Communication pursuant to Rules 70(2) and 70a(2) EPC dated Aug. 23, 2010", 1 pg.

(Continued)

*Primary Examiner* — Lun-Yi Lao
*Assistant Examiner* — Priyank Shah
(74) *Attorney, Agent, or Firm* — Schwegman Lundberg & Woessner, P.A.

(57) ABSTRACT

A louver panel for an electronic sign incorporating multiple spaced primary and secondary louvers extending outwardly from a configured substantially planar panel to provide direct shading of the structure adjacent to an LED, to the structure of the louver panel including the louvers and the panel, and to provide shading for all or part of an LED. Spacings of the louvers provide for regions of shade which improve contrast and which in transition between panels camouflage horizontal seams.

40 Claims, 19 Drawing Sheets

U.S. PATENT DOCUMENTS

| | | | | |
|---|---|---|---|---|
| 5,949,581 | A * | 9/1999 | Kurtenbach et al. | 359/621 |
| 6,309,074 | B1 | 10/2001 | Inbar et al. | |
| 6,314,669 | B1 | 11/2001 | Tucker | |
| 6,329,593 | B1 | 12/2001 | Yang | |
| 6,414,650 | B1 | 7/2002 | Nicholson et al. | |
| 6,661,429 | B1 | 12/2003 | Phan | |
| 6,677,918 | B2 * | 1/2004 | Yuhara et al. | 345/1.3 |
| 6,691,443 | B1 * | 2/2004 | Slayden | 40/546 |
| D487,779 | S | 3/2004 | Rose | |
| 6,705,033 | B1 | 3/2004 | Greene et al. | |
| 6,729,054 | B1 | 5/2004 | VanderTuin | |
| 6,737,983 | B1 | 5/2004 | Temple | |
| 6,741,222 | B1 | 5/2004 | Tucker | |
| 6,813,853 | B1 | 11/2004 | Tucker | |
| 6,816,389 | B1 | 11/2004 | Lutz et al. | |
| 6,831,653 | B2 | 12/2004 | Kehlet et al. | |
| 6,926,375 | B2 | 8/2005 | Nagamine et al. | |
| 6,966,674 | B2 | 11/2005 | Tsai | |
| 6,994,448 | B1 | 2/2006 | Gorrell | |
| 7,014,916 | B2 | 3/2006 | Tanabe | |
| 7,050,024 | B2 | 5/2006 | LeChevalier et al. | |
| 7,055,271 | B2 | 6/2006 | Lutz et al. | |
| D526,361 | S | 8/2006 | Yasuoka et al. | |
| 7,344,902 | B2 | 3/2008 | Basin et al. | |
| 7,355,562 | B2 | 4/2008 | Schubert et al. | |
| 7,907,133 | B2 | 3/2011 | Joffer et al. | |
| 7,916,156 | B2 | 3/2011 | Brown Elliott et al. | |
| 7,928,968 | B2 * | 4/2011 | Shon et al. | 345/204 |
| 7,969,456 | B2 | 6/2011 | Brown Elliott et al. | |
| 8,130,175 | B1 | 3/2012 | Joffer et al. | |
| 8,172,097 | B2 | 5/2012 | Nearman et al. | |
| 2002/0059742 | A1 | 5/2002 | Okazaki et al. | |
| 2002/0140655 | A1 | 10/2002 | Liang et al. | |
| 2003/0058191 | A1 | 3/2003 | Yuhara et al. | |
| 2003/0217495 | A1 | 11/2003 | Nagamine et al. | |
| 2004/0046721 | A1 | 3/2004 | Yang | |
| 2004/0130536 | A1 | 7/2004 | Tanabe | |
| 2004/0150651 | A1 | 8/2004 | Phan | |
| 2005/0081414 | A1 * | 4/2005 | Lutz et al. | 40/564 |
| 2005/0259418 | A1 | 11/2005 | Callegari et al. | |
| 2006/0092162 | A1 | 5/2006 | Deering et al. | |
| 2006/0105485 | A1 | 5/2006 | Basin et al. | |
| 2006/0232525 | A1 | 10/2006 | Chou et al. | |
| 2008/0048200 | A1 | 2/2008 | Mueller et al. | |
| 2008/0078733 | A1 | 4/2008 | Nearman et al. | |
| 2008/0141570 | A1 | 6/2008 | Nearman et al. | |
| 2008/0225143 | A1 | 9/2008 | Joffer et al. | |
| 2011/0163942 | A1 | 7/2011 | Joffer et al. | |
| 2011/0175888 | A1 | 7/2011 | Joffer et al. | |
| 2012/0119980 | A1 | 5/2012 | Joffer et al. | |

FOREIGN PATENT DOCUMENTS

| | | | |
|---|---|---|---|
| EP | 1699036 | A1 | 9/2006 |
| JP | 2005/275178 | A * | 10/2005 |
| WO | WO-91/08565 | A1 | 6/1991 |

OTHER PUBLICATIONS

"European Application No. 08742865.2, Response filed Feb. 23, 2011 to Communication dated Aug. 23, 2010", 13 pgs.
"U.S. Appl. No. 11/786,720, Notice oF Allowance mailed Nov. 16, 2010", 6 pgs.
"U.S. Appl. No. 11/786,720, Response filed Sep. 24, 2010 to Non-Final Office Action mailed Jun. 24. 2010", 10 pgs.
"U.S. Appl. No. 11/786,720, Non-Final Office Action mailed Jun. 24, 2010", 9 pgs.
"European Application No. 08742865.2, Extended European Search Report mailed Aug. 4, 2010", 7 pgs.
"U.S. Appl. No. 11/271,404, Election filed Jan. 7, 2009 in response to Official Action mailed Jan. 2, 2009", 12 pgs.
"U.S. Appl. No. 11/271,404, Non-Final Office Action mailed Apr. 13, 2009", 4 pgs.
"U.S. Appl. No. 11/271,404, Official Action mailed Jan. 2, 2009", 5 pgs.
"U.S. Appl. No. 11/642,221, Final Office Action mailed Dec. 17, 2009", 6 pgs.
"U.S. Appl. No. 11/642,221, Non-Final Office Action mailed Mar. 16, 2009", 5 pgs.
"U.S. Appl. No. 11/642,221, Preliminary Amendment mailed Feb. 28, 2007", 9 pgs.
"U.S. Appl. No. 11/642,221, Response Filed Apr. 15, 2010 to Final Office Action mailed Dec. 17, 2009", 10 pgs.
"U.S. Appl. No. 11/642,221, Response filed Aug. 10, 2009 to Non Final Office Action mailed Mar. 16, 2009", 9 pgs.
"U.S. Appl. No. 11/786,720, Preliminary Amendment filed Mar. 18, 2008", 12 pgs.
"U.S. Appl. No. 11/786,720, Preliminary Amendment filed Nov. 9, 2009", 10 pgs.
"U.S. Appl. No. 12/217,011, Preliminary Amendment and Filing Receipt Correction filed Sep. 2, 2008", 6 pgs.
"International Application Serial No. PCT/US06/36683, International Preliminary Report on Patentability completed Oct. 10, 2008", 6 pgs.
"International Application Serial No. PCT/US06/36683, International Search Report mailed Aug. 9, 2007", 1 pg.
"International Application Serial No. PCT/US06/36683, Written Opinion mailed Aug. 9, 2007", 4 pgs.
"International Application Serial No. PCT/US07/25456, International Search Report mailed Apr. 16, 2008", 1 pg.
"International Application Serial No. PCT/US07/25456, Written Opinion mailed Apr. 16, 2008", 4 pgs.
"International Application Serial No. PCT/US08/04808, International Search Report mailed Jul. 30, 2008", 2 pgs.
"International Application Serial No. PCT/US08/04808, Written Opinion mailed Jul. 30, 2008", 4 pgs.
"U.S. Appl. No. 13/047,193, Final Office Action mailed Nov. 25, 2011", 15 pgs.
"U.S. Appl. No. 12/217,011, Non Final Office Action mailed Aug. 10, 2011", 13 pgs.
"U.S. Appl. No. 13/047,193, Non Final Office Action mailed Aug. 30, 2011", 15 pgs.
"U.S. Appl. No. 13/076,857, Non Final Office Action mailed Aug. 22, 2011", 17 pgs.
"U.S. Appl. No. 12/217,011, Notice of Allowance mailed Oct. 27, 2011", 8 pgs.
"U.S. Appl. No. 12/217,011, Response filed Oct. 7, 2011 to Non Final Office Action mailed Aug. 10, 2011", 8 pgs.
"U.S. Appl. No. 13/047,193, Response filed Nov. 1, 2011 to Non Final Office Action mailed Aug. 30, 2011", 15 pgs.
"U.S. Appl. No. 13/076,857, Final Office Action mailed Nov. 10, 2011", 17 pgs.
"U.S. Appl. No. 13/076,857, Response filed Nov. 1, 2011 to Non Final Office Action mailed Aug. 22, 2011", 15 pgs.
"U.S. Appl. No. 11/642,221, Notice of Allowance mailed Nov. 28, 2011", 7 pgs.
"U.S. Appl. No. 13/047,193, Response filed Feb. 1, 2012 to Final Office Action mailed Nov. 25, 2011", 14 pgs.
"U.S. Appl. No. 13/076,857, Response filed Jan. 23, 2012 to Final Office Action mailed Nov. 10, 2011", 13 pgs.
"U.S. Appl. No. 13/359,095, Notice of Allowance mailed Apr. 12, 2012", 10 pgs.
"European Application Serial No. 07862836.9, Supplementary European Search Report mailed Feb. 7, 2012", 6 pgs.

* cited by examiner

LOUVER PANEL FOR AN ELECTRONIC SIGN

CROSS REFERENCES TO RELATED APPLICATIONS

This application claims priority from the earlier filed U.S. Provisional Application No. 60/958,509 filed Jul. 6, 2007, entitled "LED Electronic Display Louver for Interleaved Pixel Layout", and is hereby incorporated into this application by reference as if fully set forth herein.

This patent application is a continuation-in-part (CIP) of application Ser. No. 12/217,011 filed Jul. 1, 2008 entitled "Pixel Interleaving Configuration for Use in High Definition Electronic Sign Displays", filed concurrently herewith, a copy of which is attached and the disclosure of which is incorporated herein by reference, which is a continuation-in-part (CIP) of application Ser. No. 11/786,720 filed on Apr. 12, 2007, entitled "Pixel Interleaving Configuration for Use in High Definition Electronic Sign Displays", which is pending.

BACKGROUND OF THE INVENTION

1. Field of the Invention

The present invention is for a louver panel for use with an electronic sign, and more specifically, preferably for an electronic sign having interleaved pixels.

2. Description of the Prior Art

Prior art electronic signs often incorporate shading devices to improve visibility, readability and general appearance of information displayed on an electronic sign. Ambient light, whether it be man-made or natural sunlight, can hinder viewing caused by a washout of the lighting elements of the electronic sign. Accordingly, shading devices have been provided in many forms, one including individual shade members for individual illuminated display devices aligned over and about the top of a light emitting diode (LED), a commonly used light device used to illuminate an electronic sign. Other shading devices have been provided by utilizing an elongated rectangular blade extending outwardly from a panel over one or more rows of multiple LED devices. Attempts to provide effective shading offered a limited degree of success and have done little to improve contrast or readability. In some arrangements, the use of louver (blade) devices, while providing some shading to the LEDs, included visual interference such as a hampering viewing of the LEDs from the side and/or above or below an LED display array. Sideways viewing of the prior art sign LEDs can be hampered by LEDs having close spacing whereby one LED can be blocking another LED. Other visual inconsistencies exist where LED panels are adjacently located and aligned in a vertical or horizontal juxtaposition such that unsightly or distracting vertically or horizontally aligned spaces between the LED panels are noticeable and visible to the viewer.

Use of the present invention in association with an electronic sign maximizes viewing angles, camouflages horizontal and vertical seams, and maximizes contrast of an LED display. This invention provides a better quality and highly consistent image with considerably larger viewing angles compared to other louvers on identically sized LED display screens. The unique shape of primary and secondary louvers and spacings therebetween provide multiple regions of shading for a higher LED background contrast and add shading to camouflage the seams between the modules of adjacent LED displays. The unique louver shapes and associations also provide expanded vertical, horizontal and angular viewing angles in a preferred embodiment having rectangular louvers and, in an alternative embodiment, having scallop shaped louvers. Embodiments having primary and secondary louvers are provided, the first of which favors contrast and the second of which, as an alternative embodiment, favors viewability from multiple viewing positions.

SUMMARY OF THE INVENTION

The general purpose of the present invention is to provide a louver panel for use with an electronic sign.

According to one or more embodiments of the present invention, there is provided a louver panel for use with an electronic sign which panel has a plurality of holes for accommodating a plurality of LEDs in an electronic sign and which panel has horizontally aligned primary and secondary louvers in close or wide juxtaposition arranged in columns and rows and extending outwardly and in a regular pattern from the panel and spaced from the top and bottom edges of the holes in the panel. The horizontally aligned primary and secondary louvers are also located at the top and bottom of the planar regions (without holes) which are interspersed with the regions of the panel upon which the holes are located. The horizontally aligned primary and secondary louvers are rectangular in shape in order to provide maximum LED background contrast. The horizontally aligned primary and secondary louvers can be widely spaced or closely spaced in vertical respect to one another. With respect to an upward viewing position, i.e., viewing generally from above, wide spacing provides for primary shading produced by the primary louver which projects upon and/or influences major panel surfaces and on the LEDs, and close spacing provides for secondary shading produced by the secondary louver which projects upon and/or influences the minor panel surfaces between closely spaced primary and secondary louvers, as well as on one surface of the secondary louver. Secondary shadings by a secondary louver at the bottom edge of a panel can provide for perceptive visual hiding or blending of horizontally aligned gaps between vertically arranged panels. Other viewing positions provide for shadings of other surfaces of the invention, as well as gaps between vertically arranged panels. Regularly spaced vertically aligned grooves are provided along the front surface of the panels for perceptive visual hiding or blending of the vertical gap between the vertical edges of horizontally adjacent panels. The horizontally aligned primary and secondary louvers are spaced horizontally to include viewing spaces between the left and right louver edges in order that the entire vertically aligned grooves may be viewed without restriction. An alternative embodiment having arcuate or scalloped primary and secondary louvers is also provided in order to provide greater angular viewability from multiple viewing positions.

Significant aspects and features of the present invention are included which generally are common for both the preferred embodiment and an alternative embodiment. References addressing only the alternative embodiment are prefaced with the phrase "in an alternative embodiment."

One significant aspect and feature of the louver panel for use with an electronic sign is a near-seamless view of the modules comprising the display screen.

Another significant aspect and feature of the louver panel for use with an electronic sign is the provision for a higher viewing contrast on LED display screens.

Still another significant aspect and feature of the louver panel for use with an electronic sign is improved viewing angles vertically, horizontally, and diagonally.

One significant aspect and feature of the louver panel for use with an electronic sign is a better quality, highly consistent image compared to the use of other louvers on identically sized LED display screens.

One significant aspect and feature of the louver panel for use with an electronic sign is the use of primary and secondary louvers extending horizontally from a panel.

One significant aspect and feature of the louver panel for use with an electronic sign is the use of primary louvers and secondary louvers which are rectangularly shaped in order to favor and provide maximum contrast.

In an alternative embodiment, one significant aspect and feature of the louver panel for use with an electronic sign is the use of primary louvers and secondary louvers which can be arcuate or scallop shaped in order to favor and provide for maximum all around viewability and visibility.

One significant aspect and feature of the louver panel for use with an electronic sign is the use of primary shading generated by primary louvers.

One significant aspect and feature of the louver panel for use with an electronic sign is the use of secondary shading provided by secondary louvers.

One significant aspect and feature of the louver panel for use with an electronic sign is the use of primary louvers and secondary louvers which can be widely spaced about holes in a panel accommodating LEDs of an electronic sign and which louvers can be widely spaced about planar regions (without holes) of the panel.

One significant aspect and feature of the louver panel for use with an electronic sign is the use of primary louvers and secondary louvers which can be widely spaced where, depending on the light source position, primary shading is provided on one or more surfaces of the primary louvers, and where, depending again on the light source position, secondary shading is provided on one or more surfaces of the secondary louvers. Depending on the light source position, primary shading or secondary shading is provided for the LEDs of an electronic sign, and primary shading or secondary shading, or both, can be provided for major and minor planar regions of the louver panel.

One significant aspect and feature of the louver panel for use with an electronic sign is the use of closely spaced primary louvers and secondary louvers which can provide primary shading or secondary shading for horizontally oriented gaps between vertically adjacent panels in order to provide for perceptive visual hiding or blending of horizontally aligned gaps between vertically adjacent panels, as well as for perceptive visual hiding or blending of horizontally aligned gaps with the rows of closely spaced primary and secondary louvers which also have shading.

Another significant aspect and feature of the louver panel for use with an electronic sign is the use of vertically aligned grooves on the front surface of the louver panel in order to provide for perceptive visual hiding or blending of vertically aligned gaps between horizontally adjacent louver panels.

Another significant aspect and feature of the louver panel for use with an electronic sign is the use of viewing areas between primary and secondary louvers which allow viewing of the vertically aligned grooves on the front surface of the louver panel in order to provide for perceptive visual hiding or blending of vertically aligned gaps between horizontally adjacent panels.

Another significant aspect and feature of the louver panel for use with an electronic sign is the use of rectangular primary and secondary louvers having an angular viewing window with an upward viewing angle of 28° in combination with a downward viewing angle of 40°.

In an alternative embodiment, another significant aspect and feature of the louver panel for use with an electronic sign is the use of arcuate primary and secondary louvers having an angular viewing window with an upward viewing angle of 33° in combination with a downward viewing angle of 45°.

In an alternative embodiment, another significant aspect and feature of the louver panel for use with an electronic sign is the use of viewing spaces between arcuate primary and secondary louvers which allow for viewing of a plurality of LEDs through such viewing spaces from left and right offset upward and downward viewing positions in order to provide for maximum all around visibility.

Yet another significant aspect and feature of the louver panel for use with an electronic sign is a horizontal viewing angle of 140°.

In an alternative embodiment, another significant aspect and feature of the louver panel for use with an electronic sign is the use of multiple viewing spaces between arcuate primary and secondary louvers which allow for viewing of LEDs through such multiple viewing spaces from left and right offset upward and downward viewing positions in order to provide for maximum all around viewability and visibility.

Having thus briefly described one or more embodiments of the present invention, and having mentioned some significant aspects and features of the present invention, it is the principal object of the present invention to provide a louver panel for use with an electronic sign.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
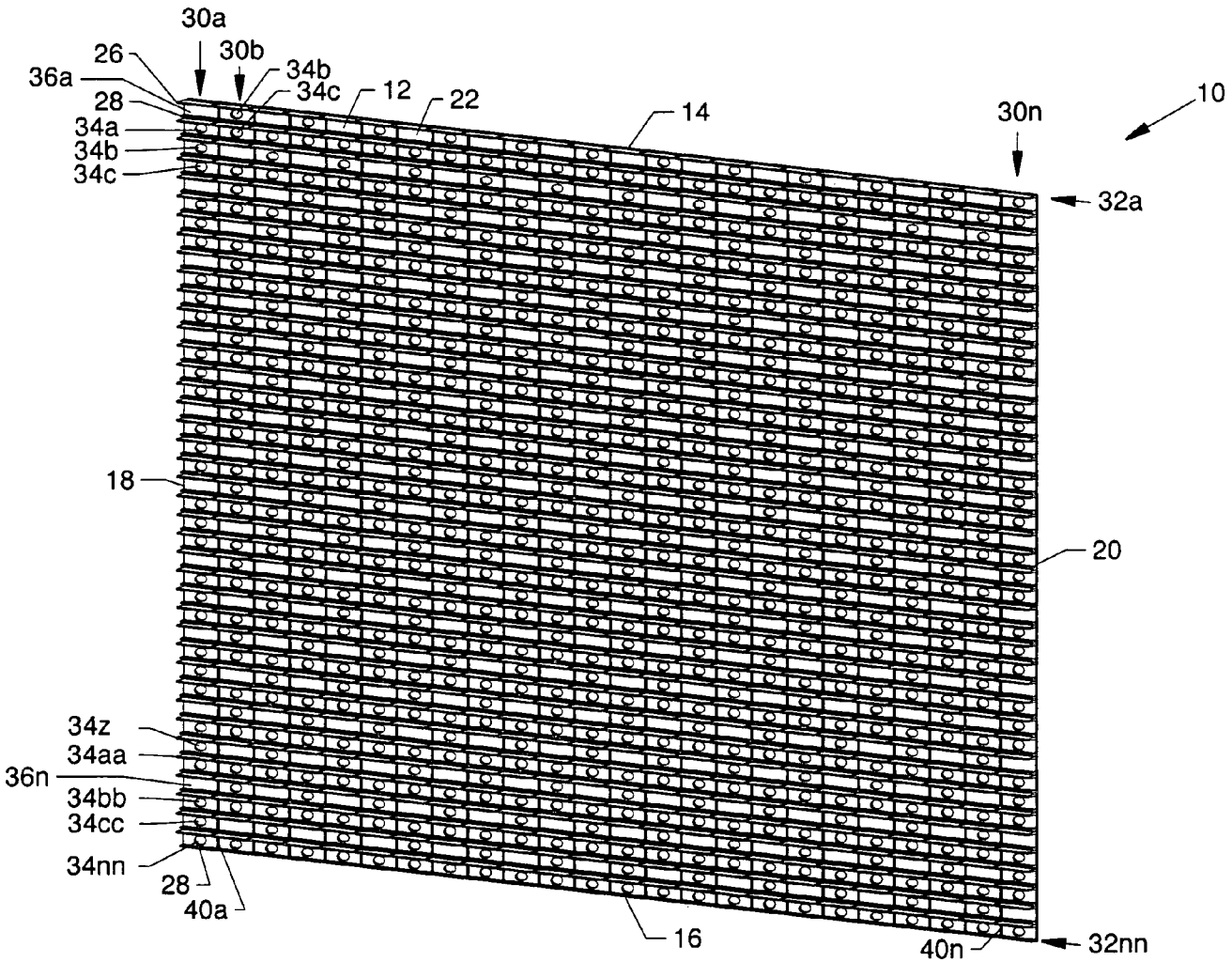
FIG. 1 is an isometric front view of a louver panel for use with an electronic sign, the present invention.

FIG. 1 is an isometric front view of a louver panel for use with an electronic sign 10, the present invention, alternately referred to as the louver panel 10. The louver panel for use with an electronic sign 10 is geometrically configured and formed of, but not limited to, a suitable plastic or metal material. A substantially planar panel 12, which serves as the base of the invention, includes a top edge 14, an opposed bottom edge 16, a left side edge 18, an opposed right side edge 20, and also includes a front surface 22 and an opposed rear surface 24 (FIG. 2), each surface of which extends between the top edge 14, the bottom edge 16, the left side edge 18, and the right side edge 20 and also includes other significant features as now described. Multiple arrangements of rectangularly shaped planar protrusions in the form of primary and secondary louvers 26 and 28, respectively, extend outwardly and forwardly from the front surface 22 of the panel 12 and are arranged in a plurality of columns 30*a*-30*n* and in a plurality of rows 32*a*-32*nn* in regularly repeating patterns related to the pattern of the placement of a plurality of holes 34*a*-34*nn* in the panel 12 through which a plurality of light emitting diodes (LEDs) of different colors can extend, and are also related to the generally smaller planar regions 36*a*-36*n* of the panel 12 interspersed in a regularly repeating pattern with respect to the plurality of holes 34*a*-34*nn*. The top row 32*a* includes only primary louvers 26, the bottom row 32*nn* includes only secondary louvers 28, and the rows between the top row 32*a* and the bottom row 32*nn* contain closely arranged and spaced primary louvers 26 and secondary louvers 28, as shown in FIG. 3. The plurality of holes 34*a*-34*nn* are arranged vertically in groups of three or in partial groups where, for example, the top hole 34*a* in a complete group could accommodate a blue LED, the middle hole 34*b* could accommodate a green LED, and the bottom hole 34*c* could accommodate a red LED. The pluralities of holes 34*a*-34*nn* are staggered with respect to adjacent columns 30*a*-30*n* where the bottom or top of some columns may only contain one or two of the holes 34*a*-34*nn* in order that orderly LED continuity and LED color arrangement can extend from vertically adjacent panels 12 in use with multiple electronic display modules.

Figure 2:
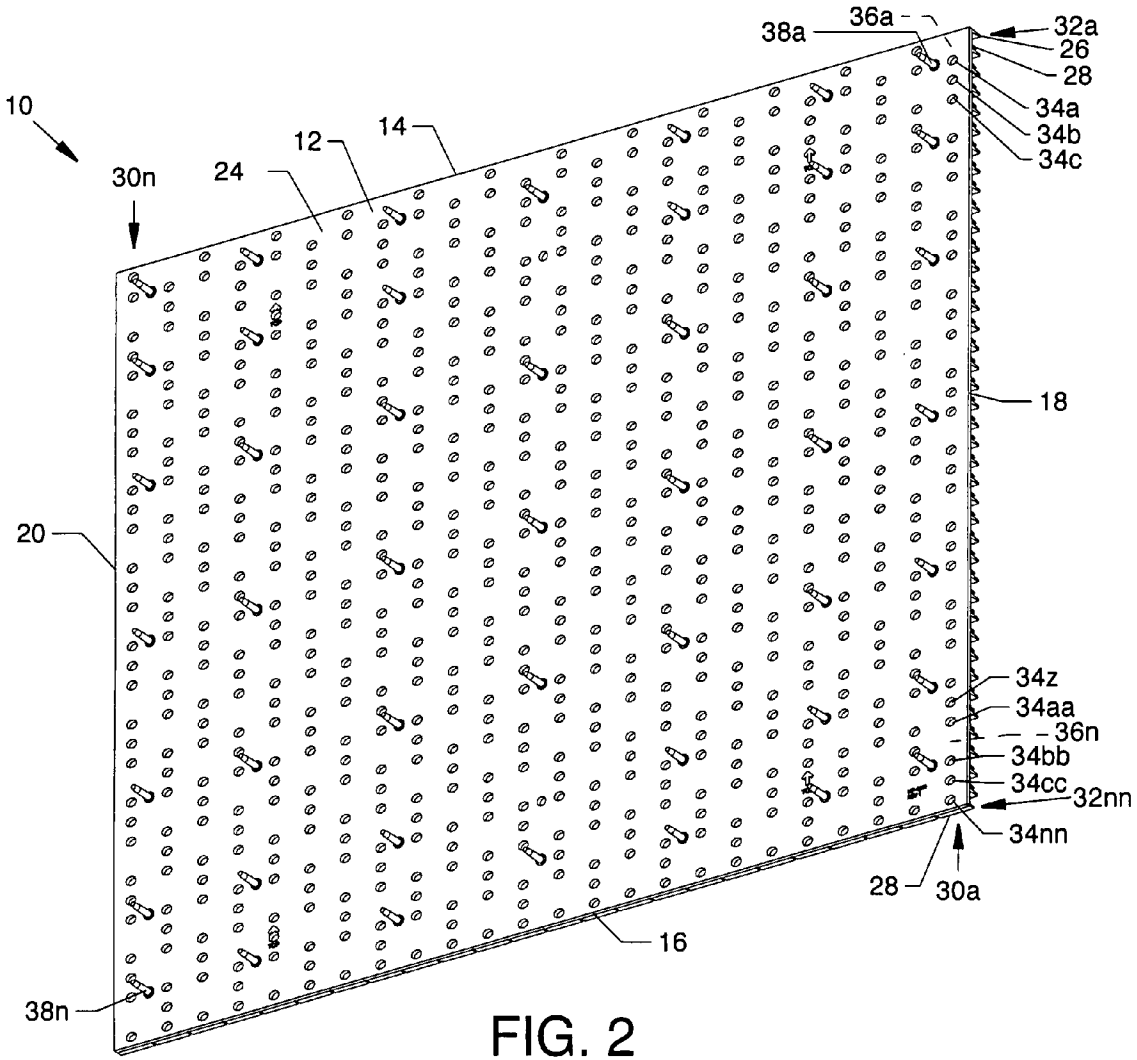
FIG. 2 is an isometric rear view of the louver panel for use with an electronic sign.
Figure 3:
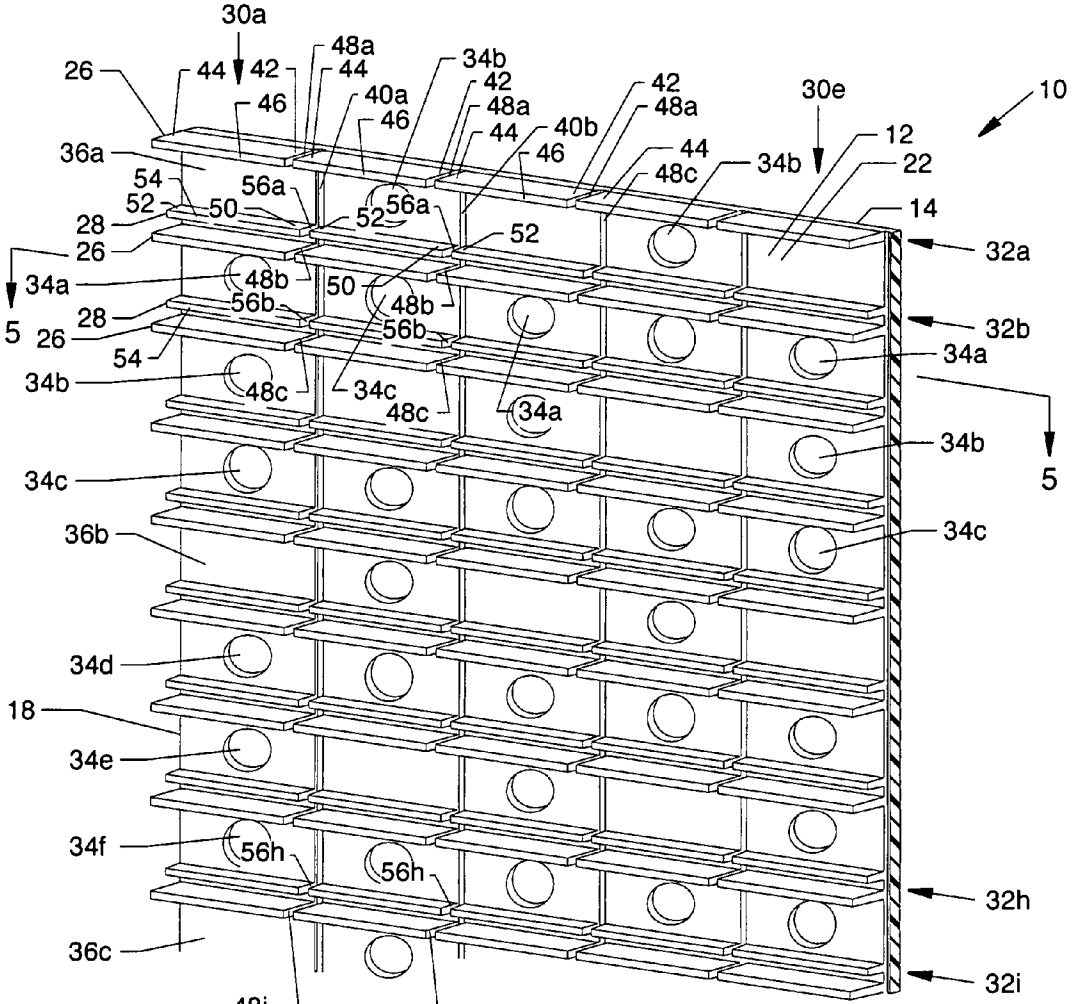
FIG. 3 is an isometric front view of a section of the upper left corner of the louver panel for use with an electronic sign.

FIG. 2 is an isometric rear view of the louver panel for use with an electronic sign 10. Shown in particular is a plurality of mattel pins 38*a*-38*n* extending rearwardly from the panel 12, which pins are used to align and secure components of an electronic sign. The mattel pins 38*a*-38*n* can align with and pass through an LED circuit board to matingly align with and secure to the main housing of an electronic display module, one or more combinations of which can comprise an electronic sign. Also shown is the plurality of holes 34*a*-34*nn* which is distributed along each of the columns 30*a*-30*n*.

Figure 4:
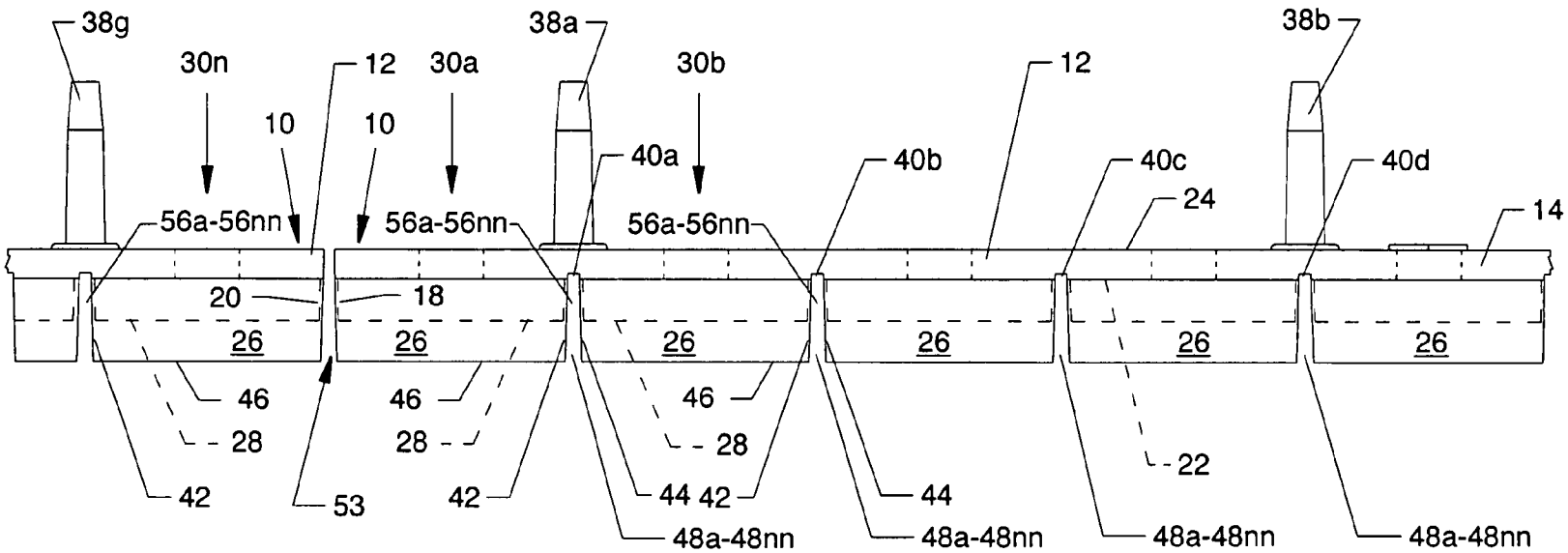
FIG. 4 is a top view of a section of the upper left corner of the louver panel juxtaposing a portion of an adjacent louver panel.
Figure 5:
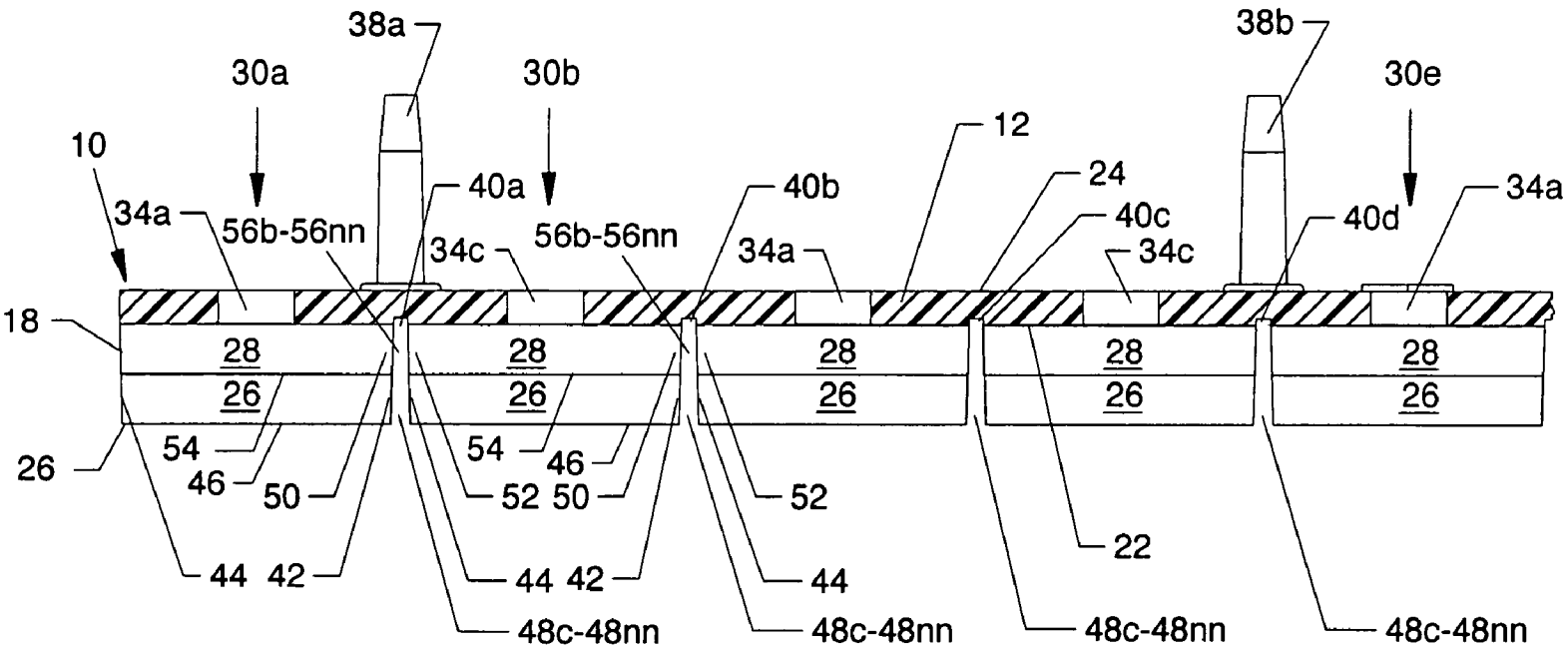
FIG. 5 is a top cross section view of the upper left corner of the louver panel along line 5-5 of FIG. 3.

FIG. 3 is an isometric view of a section of the upper left corner of the louver panel for use with an electronic sign 10 showing the relationships, structure and arrangement of the primary louvers 26 and the secondary louvers 28, the holes 34*a*-34*nn*, the planar regions 36*a*-36*n* of the panel 12, and other directly associated features. FIG. 4 is a top view of a section of the upper left corner of the louver panel 10 juxtaposing a portion of an adjacent louver panel 10. FIG. 5 is a top cross section view of the upper left corner of the louver panel 10 along line 5-5 of FIG. 3. The arrangement of the primary louvers 26, the secondary louvers 28, the holes 34*a*-34*nn*, and the interspersed rectangular shaped planar regions 36*a*-36*n* benefit visuality in terms of increased contrast and LED viewability by providing shading for LEDs extending through the holes 34*a*-34*nn*, as well as for the planar regions 36*a*-36*n* and associated various top and bottom surfaces of the primary louvers 26 and the secondary louvers 28 and the regions between the primary louvers 26 and the secondary louvers 28. Some primary louvers 26 extend outwardly from the panel 12 and are distanced from and spacingly located a short distance above some of the holes 34*a*-34*nn*. Other primary louvers 26 extend outwardly from the panel 12 and are located at the upper portion of each of the planar regions 36*a*-36*n*. Some secondary louvers 28 extend outwardly from the panel 12 and are distanced from and spacingly located a short distance below each of the holes 34*a*-34*nn*. Other secondary louvers 28 extend outwardly from the panel 12 and are located at the lower portion of each of the planar regions 36*a*-36*n*. The widths of the primary and secondary louvers 26 and 28 are the same; however, the depth of the primary and secondary louvers 26 and 28, respectively, differs, i.e., the primary louvers 26 extend outwardly a further distance from the panel 12 than the secondary louvers 28. Such benefits are described in detail in FIGS. 6, 6*a*, 7 and 7*a*.

Furthermore, other visual benefits are derived from these and/or other features of the present invention to improve the presented visual uniformity and regularity of visual perception, whereby visible lines including vertically oriented lines and horizontally oriented lines formed between horizontally adjacent and vertically adjacent panels 12 are blended into a pattern and, therefore, pattern regularity is visually perceived by the sign observer.

Vertically oriented gaps formed by the close association of the left and right edges 18 and 20, respectively, of horizontally adjacent louver panels 10 are associated with and visually blend with a plurality of vertically oriented grooves 40*a*-40*n* distributed and extending between the top edge 14 and the bottom edge 16 along the front surface 22 of the panel 12. Correspondingly, the inner right edges 42 and inner left edges 44 of adjacent primary louvers 26 extend from a front edge 46 of the rectangular shaped primary louvers 26 to the front surface 22 of the panel 12 to meet and align with the plurality of grooves 40*a*-40*n*, thereby forming a plurality of viewing spaces 48*a*-48*n* between horizontally adjacent primary louvers 26, whereby viewing of the grooves 40*a*-40*n* and a vertically oriented gap 53 (FIG. 4) between the louver panels 10 can be achieved by the viewer. The viewing spaces 48*a*-48*nn* are also distributed in columnar fashion in alignment between the columns 30*a*-30*n*. Additionally, and in a like and similar fashion, the inner right edges 50 and inner left edges 52 of adjacent secondary louvers 28 extend from a front edge 54 of the rectangular shaped secondary louvers 28 to the front surface 22 of the panel 12 to meet and align with the plurality of grooves 40*a*-40*n*, thereby forming a plurality of viewing spaces 56*a*-56*nn* between adjacent secondary louvers 26, whereby viewing of the grooves 40*a*-40*n* and a gap 53 (FIG. 4) between the louver panels 10 can be achieved by a distant viewer. The viewing spaces 56*a*-56*nn* are also distributed in columnar fashion in alignment between the columns 30*a*-30*n*.

Figure 6:
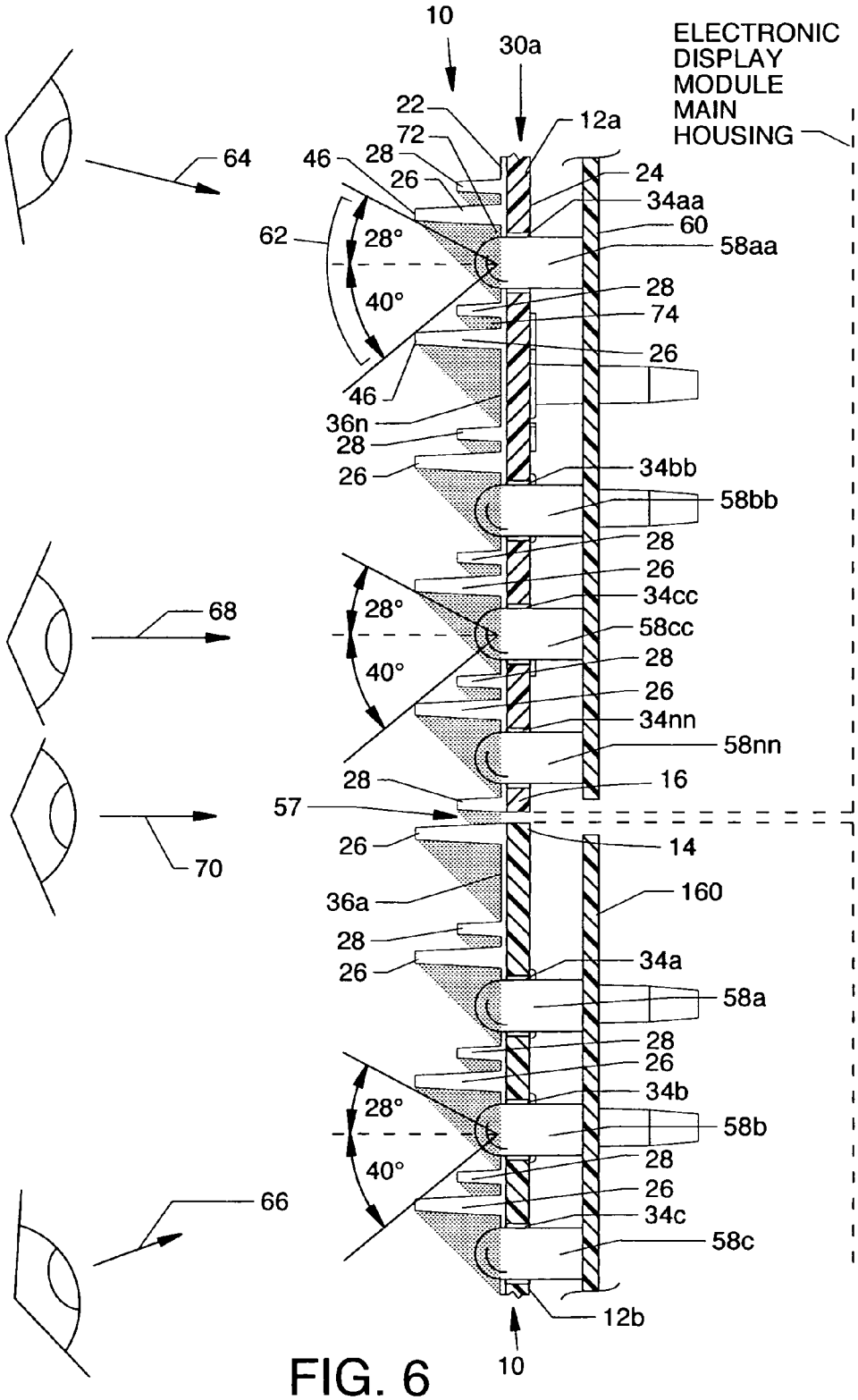
FIG. 6 shows some of the plurality of LEDs mounted to circuit boards and extending through some of the holes of vertically adjacent upper and lower louver panels and the associated shading with respect to interfering light sources which are generally located above and to the side of an electronic sign.

Referring to FIG. 6 horizontally oriented gaps 57 formed by the close association of the top edges 14 and bottom edges 16, respectively, of vertically adjacent louver panels 10 (only two of which are partially shown in FIG. 6) are also blended by the alignment in close proximity of the top edges 14 and bottom edges 16 of the periphery of the panels 12 of such louver panels 10. The primary louver 26 of the top LED row 32*a* in a lower louver panel 10 is directly below where a horizontal module splice across a gap 57 will occur with an upper louver panel 10 where the secondary louver 28 of the bottom LED row 32*nn* of an upper louver panel 10 is directly above where a horizontal louver panel 10 splice will occur. The gap 57 between the upper and lower louver panels 10 at a horizontal module splice is the same distance between the other closely spaced primary and secondary louvers 26 and 28, respectively. Consider the vertically adjacent alignment of an upper panel 12*a* and a lower panel 12*b* of vertically adjacent louver panels 10 as also shown in FIG. 6. The bottom secondary louver 28 of the upper louver panel 10 is closely but spacingly aligned to the top primary louver 26 of the lower louver panel 10 where such spaced alignment presents the visual effect closely resembling that of the vertical spacing of the closely associated top and bottom edges 14 and 16, respectively, of the primary louvers 26 and the secondary louvers 28, such as in each of the rows 32*b*-32*i* (FIG. 3), for example. This relationship helps to shade the horizontal electronic module splice (gap 57) between electronic display modules and prevents the "tiling" effect present in some electronic sign products.

Figure 7:
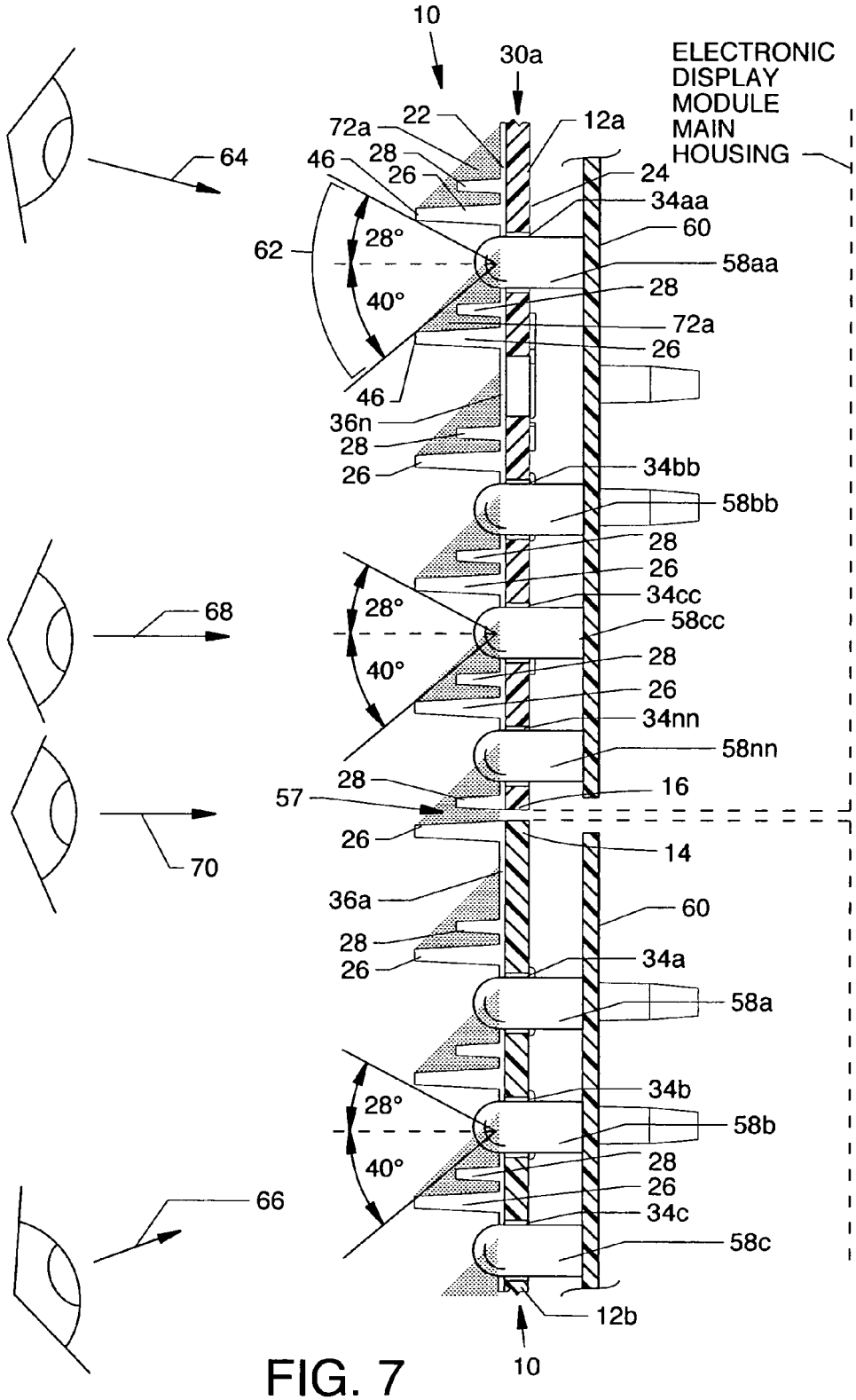
FIG. 7 shows some of the plurality of LEDs mounted to circuit boards and extending through some of the holes of vertically adjacent upper and lower panels and the associated shading with respect to interfering light sources which are generally located below and to the side of an electronic sign.

As previously mentioned, the arrangement of the primary louvers 26, the secondary louvers 28, the holes 34*a*-34*nn*, and the interspersed planar regions 36*a*-36*n* benefits visuality in terms of increased contrast and LED viewability by providing shading for LEDs extending through the holes 34*a*-34*nn*, shading for the front surface 22 surrounding the holes 34*a*-34*nn*, shading for the planar regions 36*a*-36*n*, shading for the associated various top and bottom surfaces of the primary louvers 26 and the secondary louvers 28 and shading for the major and minor regions of the front surface 22 between the primary louvers 26 and the secondary louvers 28. FIGS. 6 and 7 illustrate benefits pertaining to use of the present invention including improved visuality in terms of increased contrast and LED viewability by providing unique shading for the LEDs and other components or regions of an electronic sign.

FIGS. 6 and 7 show some of the plurality of LEDs 58*a*-58*nn* mounted to circuit boards 60 and extending through some of the holes 34*a*-34*nn* of vertically adjacent upper and lower panels 12, herein designated as upper and lower panels 12*a* and 12*b*, respectively. Preferably, the LEDs 58*a*-58*nn* are interleaved, such as in referenced application Ser. No. 11/786,720 or continuation-in-part of the patent application Ser. No. 11/786,720. With respect to viewing along the vertical aspect, the primary louvers 26 in conjunction with features of the LEDs 58*a*-58*nn* provide angular viewing windows 62 for viewing of the LEDs 58*a*-58*nn*. Viewing of the LEDs 58*a*-58*nn* through and as determined by the viewing windows 62 can be accomplished in front of and in perpendicular alignment to the LEDs 58*a*-58*nn* or viewing can be accomplished to the side of and in offset angular alignment to the left or right of the LEDs 58*a*-58*nn* where, in all cases, the straight front edges 46 of the primary louvers 26 determine the angular boundary for viewing. An upward viewing angle of the angular viewing window 62 is bounded by the angle between the longitudinal axis of the LED at the LED focal center and the lower portion of the edge 46 of an upper primary louver 26 (shown for purposes of example as being 28°) in combination with a downward viewing angle of the angular viewing window 62 which is bounded by the angle between on the longitudinal axis of the LED at the LED focal center and the upper portion of the edge 46 of a primary louver 26 distanced below the upper primary louver 26 (shown for purposes of example as being 40°).

Figure 6A:
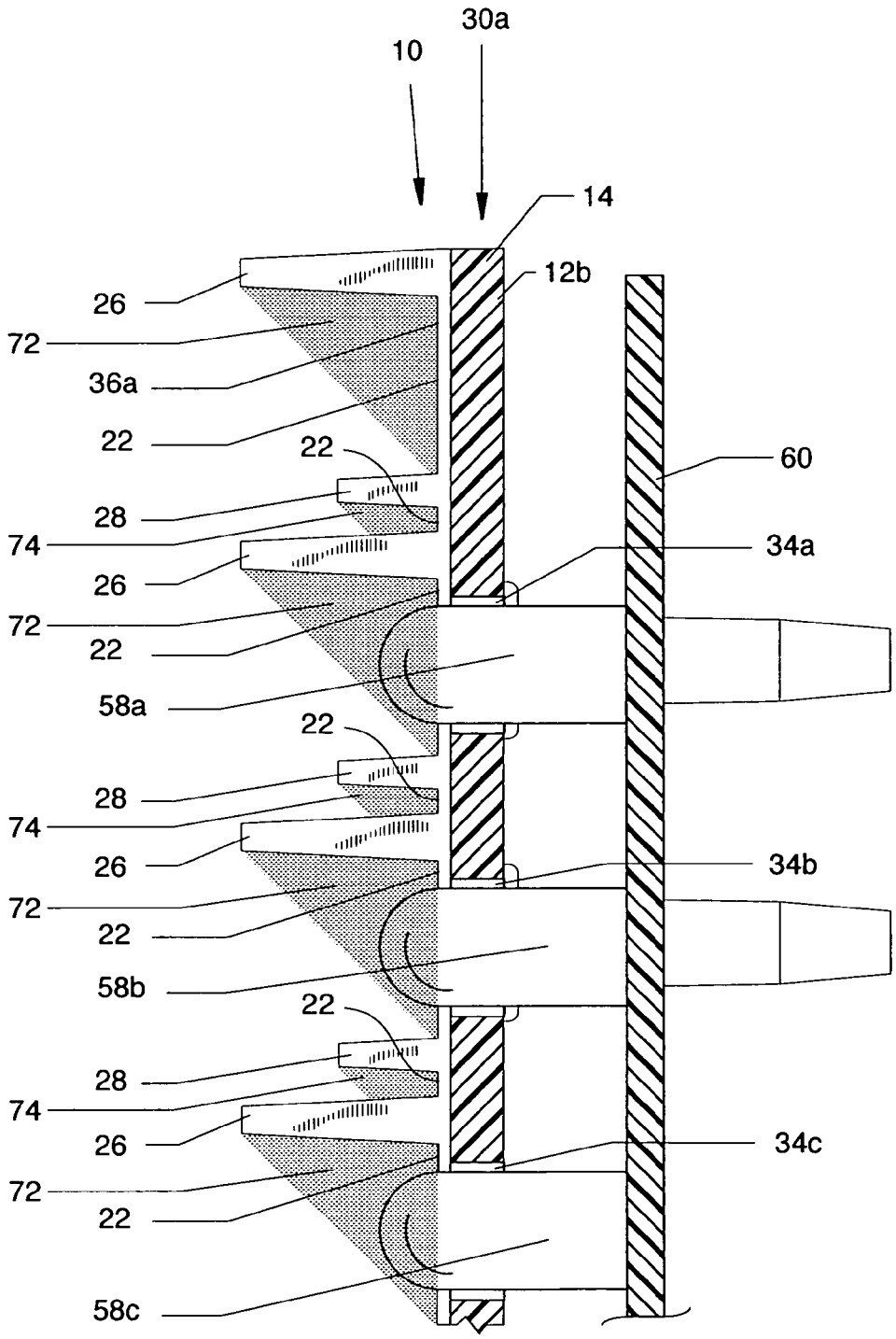
FIG. 6*a* is a detailed view of the lower portion of FIG. 6.
Figure 7A:
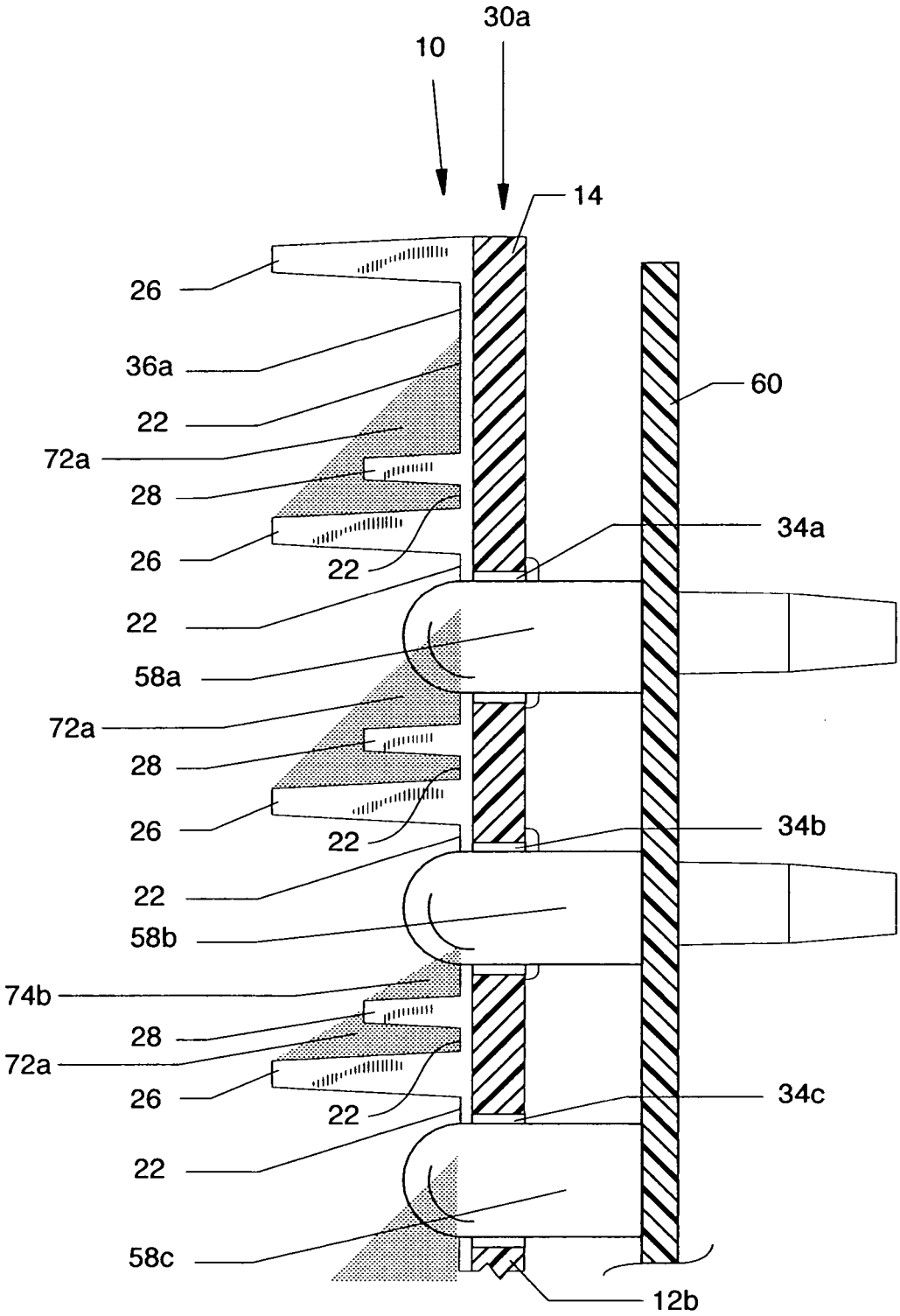
FIG. 7*a* is a detailed view of the lower portion of FIG. 7.

Furthermore, with respect to shading, FIGS. 6 and 6*a* show shadings with respect to interfering light sources which are generally located above and in front of an electronic sign having upper and lower panels 12*a* and 12*b*, and FIGS. 7 and 7*a* show shadings with respect to interfering light sources which are generally located below and in front of an electronic sign having upper and lower panels 12*a* and 12*b*. Various observer viewing situations are shown in each of the FIGS. 6 and 7, including an upward viewing position 64 where the viewer is generally located above the structure of the upper and lower panels 12*a* and 12*b*, a downward viewing position 66 where the viewer is generally below the structure of the upper and lower panels 12*a* and 12*b*, a straight-on viewing position 68 where the viewer is generally at the same level of the upper and lower panels 12*a* and 12*b*, and a straight on edge viewing position 70 where the viewer is generally afforded a view of the gap 57 between the bottom secondary louvers 28 of the upper panel 12*a* and the top primary louvers 26 of the lower panel 12*b*. Shading beneficial in terms of increased contrast and LED visibility are viewed from any of the preceding viewing positions or positions between.

Shadings, which can be in the form of shadows in FIG. 6 and as shown in closer detail in FIG. 6*a*, are shown with respect to an interfering light source which is generally above and in front of an electronic sign having upper and lower panels 12*a* and 12*b* of the present invention. FIG. 6*a* is a detailed view of the upper portion of the louver panel 12*b* and associated structures shown in FIG. 6. Shadings are formed by blocking direct or ambient light by the primary and secondary louvers 26 and 28, respectively. For example, in FIG. 6*a:*

1. Primary shadings 72 are formed by and are located on the under surface of the primary louvers 26 and project upon and/or influence the greater portion of the front surface 22 of the panel 12*b* between the widely spaced upper primary louvers 26 and the lower secondary louvers 28, as shown. If the light source is positioned horizontally closer to the plane of the panel 12*b*, the primary shading 72 would also cover a greater portion of the top surface of the underlying secondary louver 28. LEDs 58*a*-58*nn* which project through the holes 34*a*-34*nn* of the panel 12*b* are masked and/or beneficially influenced by the respective primary shadings 72.
2. Secondary shadings 74 are formed by and are located on the under surface of the secondary louvers 28 and also project upon and/or influence a portion of the front surface 22 of the panel 12*b* between closely spaced upper secondary louvers 28 and lower primary louvers 26 and also project upon and/or influence an inward portion of the top surface of the primary louvers 26, as shown. If the light source is positioned horizontally closer to the plane of the panel 12*b*, the secondary shading 74 could also cover a greater portion of the top surface of an underlying primary louver 26.

Provision of the secondary louvers 28 in combination with the primary louvers 26 is of great and significant benefit for improvement of visibility and contrast for viewing of an electronic sign using the present invention, especially where shading protection is provided for an interfering light source above and in front of an electronic sign using the louver panels 10 of the present invention. The use of the secondary louvers 28 adds a region of viewable secondary shading 74 which is complimentary to the viewable primary shading 72 provided by the primary louver 26. The various observer viewing positions 64-66 shown in FIG. 6 provide for viewing of combinations of primary and secondary shadings 72 and 74 with respect to the upper and lower surfaces of the primary louvers 26 and the secondary louvers 28, the major and minor regions of the front surfaces 22 between such louvers, and the LEDs 58*a*-58*nn*.

Although shading is described for multiple panels 12*a* and 12*b*, the effects of shading are the same using multiple panels 12, except, of course, a single panel 12 may not necessarily be considered for the purpose of hiding or blending of edges.

Shadings, which can be in the form of shadows in FIG. 7 and as shown in greater detail in FIG. 7*a*, are shown with respect to an interfering light source which is generally below and to the front of an electronic sign having upper and lower panels 12*a* and 12*b* of the present invention. FIG. 7*a* is a detailed view of the upper portion of the panel 12*b* and associated structures shown in FIG. 7. Shadings are formed by blocking direct or ambient light by the primary and secondary louvers 26 and 28, respectively. For example, in FIG. 7*a*, primary shadings 72*a* are formed by and are located on the top surfaces of the primary louvers 26 and project upon and/or influence the greater portion of the front surface 22 of the panel 12*b* between the widely spaced lower secondary louvers 28 and the upper primary louvers 26. The primary shadings 72*a* engulf all of the surfaces of the secondary louvers 28 and includes the portion of the front surface 22 of the panel 12 between the closely spaced upper secondary louvers 28 and lower primary louvers 26. A portion of the LEDs 58*a*-58*nn* which project through the holes 34*a*-34*nn* of the panel 12*b* are also masked and/or beneficially influenced by the primary shadings 72*a*, as shown.

If the light source is positioned horizontally closer to the plane of the panel 12*b*, the primary shading 72*a* would also cover a greater portion of the front surface 22 between a widely spaced lower louver 28 and upper primary louver 26 and part of the under surface of the primary louvers 26 and would also provide greater shading of the LEDs 58*a*-58*nn*. As alternatingly shown in FIG. 7*a* and with respect to LED 58*b*, if the light source is positioned vertically with respect to the plane of the panel 12*b*, a secondary shading 74*a* would cover the top surface of the secondary louver 28 and a small position of the front surface 22.

Provision of the secondary louvers 28 in combination with the primary louvers 26 is of great and significant benefit for improving the visibility and contrast of an electronic sign using the present invention, especially where shading protection is provided for an interfering light source below and to the front of an electronic sign using the louver panels 10 of the present invention, wherein the use of the secondary louvers 28 would add a region of viewable secondary shading 74*a* which would be complimentary to the viewable primary shading 72*a* provided by the primary louver 26. The various observer viewing positions 64-66 shown in FIG. 7 provide for the viewing of primary shadings 72*a* and any secondary shading 74*a* with respect to the upper and lower surfaces of the primary louvers 26 and the secondary louvers 28, the major and minor regions of the front surfaces 22 between such louvers, and the LEDs 58*a*-58*nn*.

Although shading is described for multiple panels 12*a* and 12*b*, the effects of shading are the same using multiple panels 12, except, of course, a single panel 12 may not necessarily be considered for the purpose of hiding or blending of edges.

Although vertical viewability, such as that described with respect to the angular viewing window 62, has been described in FIGS. 6 and 7, the present invention also provides for an improved horizontal viewing for use with widely spaced interleaved pixels such as described in the previously referenced parent patent application Ser. No. 11/786,720 or continuation-in-part of the patent application Ser. No. 11/786,720. As the orientation of horizontally adjacent primary louvers 26 and horizontally adjacent secondary louvers 28 is such that they lie in different horizontally oriented planes, there is no horizontal viewing restriction caused by the use of the primary louvers 26 and the secondary louvers 28.

Figure 8:
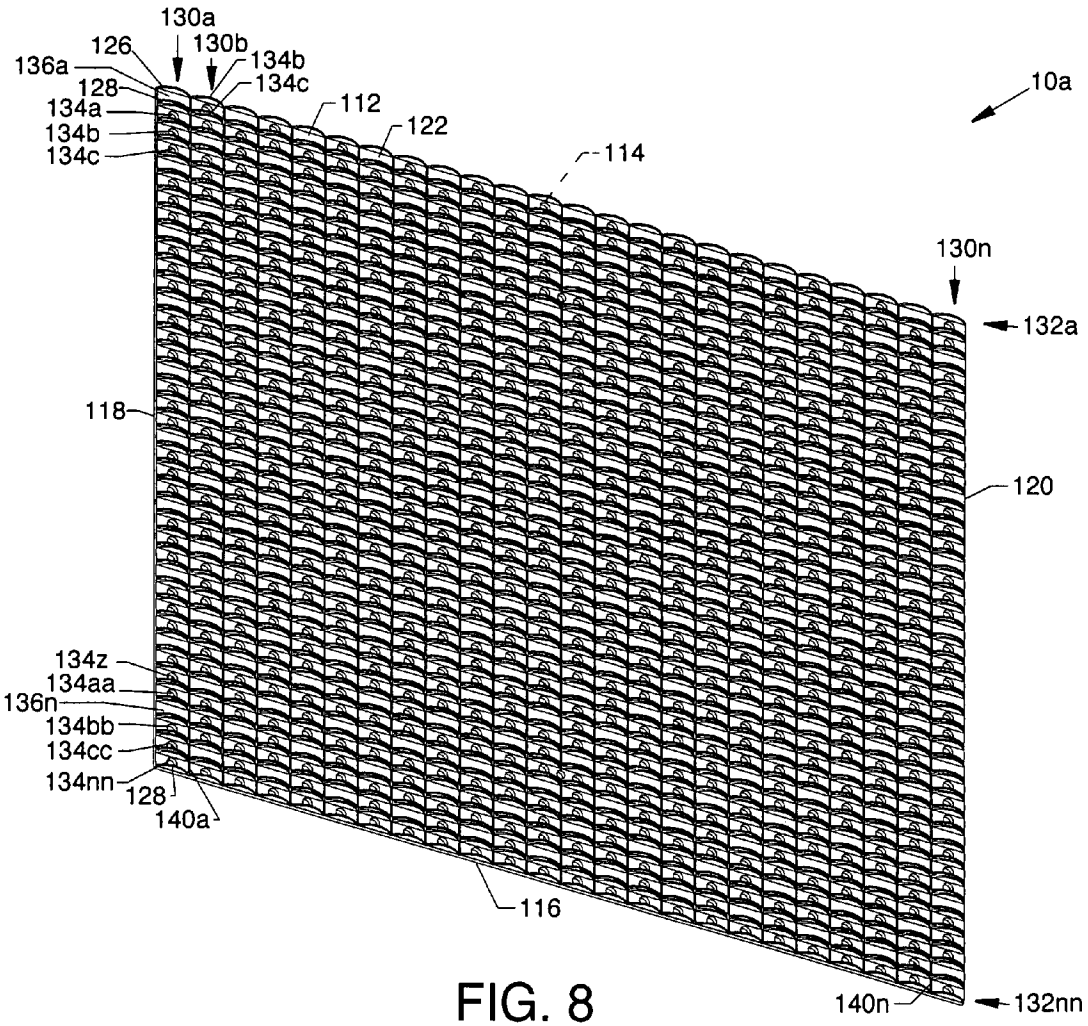
FIG. 8 is an isometric front view of an alternative embodiment of a louver panel for use with an electronic sign.

FIG. 8, an alternative embodiment fashioned after and having many features of the preferred embodiment 10, is shown in an isometric front view as a louver panel for use with an electronic sign 10*a*, also referred to as the louver panel 10*a*. The louver panel 10*a* features arcuate primary louvers 126 and arcuate secondary louvers 128, each being generally scalloped in shape in order to allow increased viewing of LEDs especially at upward, downward and sideward viewing angles at and near the junction of the arcuate edges of the primary louvers 126 and secondary louvers 128 with the panel 112, as described later in detail. The louver panel for use with an electronic sign 10*a* is geometrically configured and formed of, but not limited to, a suitable polycarbonate material. A substantially planar panel 112 which serves as the base of the present invention includes a top edge 114, an opposed bottom edge 116, a left side edge 118, an opposed right side edge 120, and also includes a front surface 122 and an opposed rear surface 124 (FIG. 9), each surface of which extends between the top edge 114, the bottom edge 116, the left side edge 118, and the right side edge 120, and includes other significant features as now described. Multiple arrangements of arcuate planar protrusions in the form of primary and secondary louvers 126 and 128, respectively, extend outwardly and forwardly from the front surface 122 of the planar panel 112. The arcuate planar protrusions are arranged in a plurality of columns 130*a*-130*n* and in a plurality of rows 132*a*-132*nn* in regular repeating patterns related to the pattern of the placement of a plurality of holes 134*a*-134*nn* in the planar panel 112 through which a plurality of light emitting diodes (LEDs) of different colors can extend. The arcuate planar protrusions are also related to the generally small planar regions 136*a*-136*n* of the planar panel 112 and are interspersed in a regular repeating pattern with respect to the plurality of holes 134*a*-134*nn*. The top row 132*a* includes only primary louvers 126, the bottom row 132*nn* includes only secondary louvers 128, and the rows between the top row 132*a* and the bottom row 132*nn* contain closely arranged and spaced primary louvers 126 and secondary louvers 128 as shown in FIG. 10. The plurality of holes 134*a*-134*nn* is arranged vertically in groups of three or in partial groups where, for example, the top hole 134*a* in a complete group could accommodate a blue LED, the middle hole 134*b* could accommodate a green LED, and the bottom hole 134*c* could accommodate a red LED. The pluralities of holes 134*a*-134*nn* are staggered with respect to adjacent columns 130*a*-130*n* where the bottom or top of some columns may only contain one or two of the holes 134*a*-134*nn* in order that orderly LED continuity and LED color arrangement can extend from vertically adjacent panels 112 in use with multiple electronic display modules.

Figure 9:
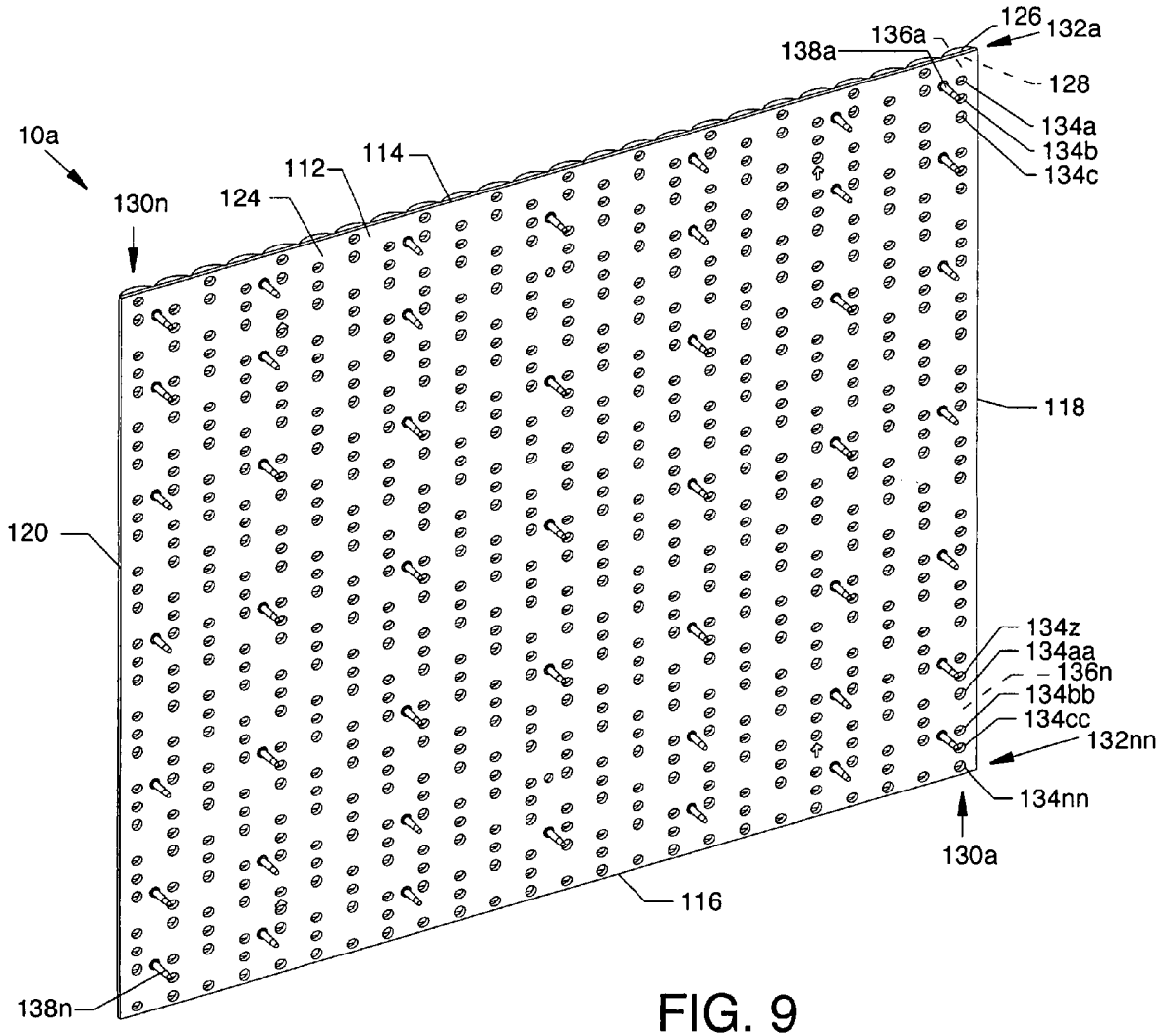
FIG. 9 is an isometric rear view of the louver panel shown in FIG. 8.
Figure 10:
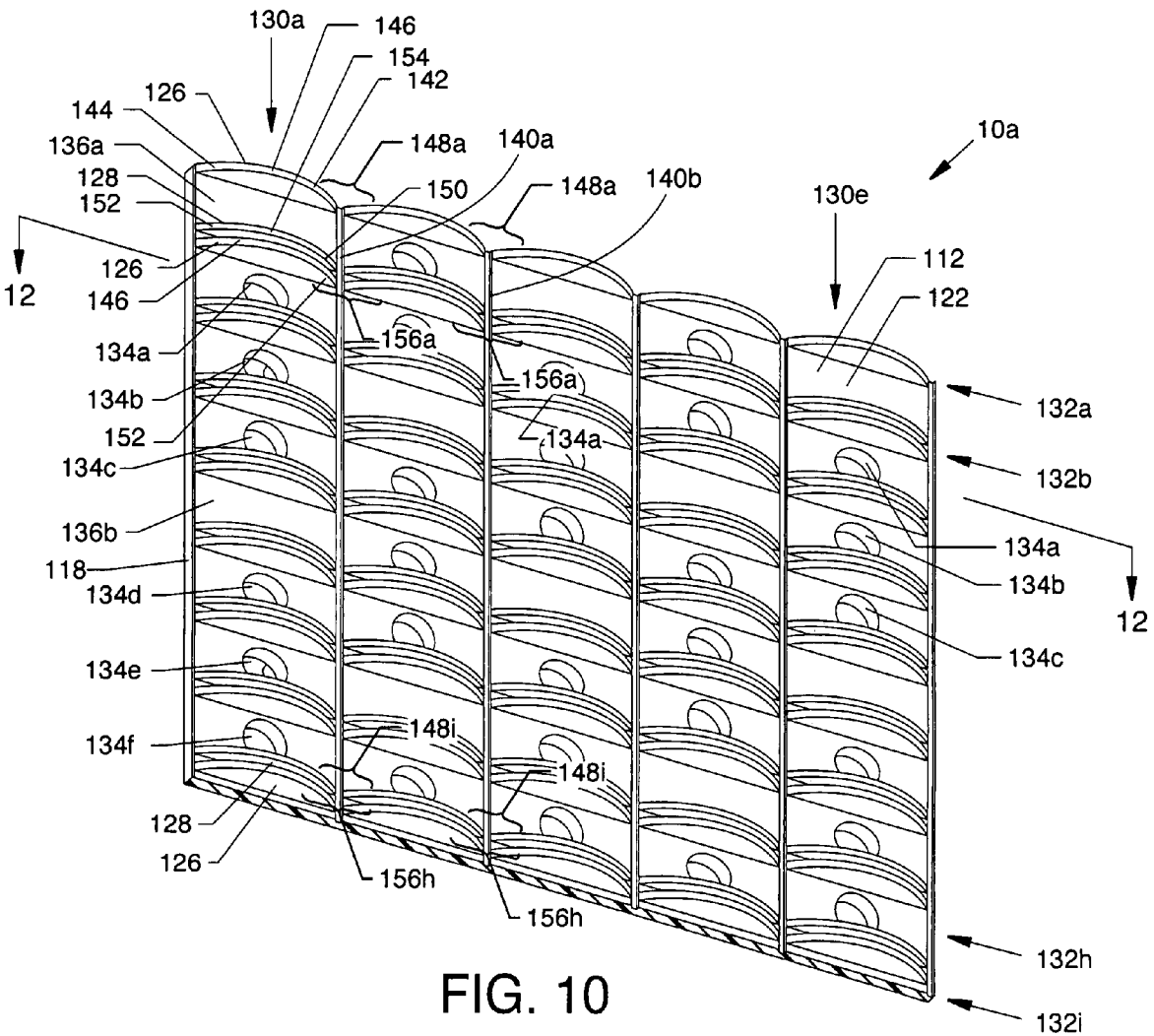
FIG. 10 is an isometric view of a section of the upper left corner of the louver panel shown in FIG. 8.

FIG. 9 is an isometric rear view of the louver panel for use with an electronic sign 10*a*. Shown, in particular, is a plurality of mattel pins 138*a*-138*n* extending rearwardly from the panel 112, which pins are used to align and secure components of an electronic sign. The mattel pins 138*a*-138*n* can align with and pass through an LED circuit board to matingly align with and secure to the main housing of an electronic display module, one or more combinations of which can comprise an electronic sign. Also shown is the plurality of holes 134*a*-134*nn* which holes are distributed along each of the columns 130*a*-130*n*.

Figure 11:
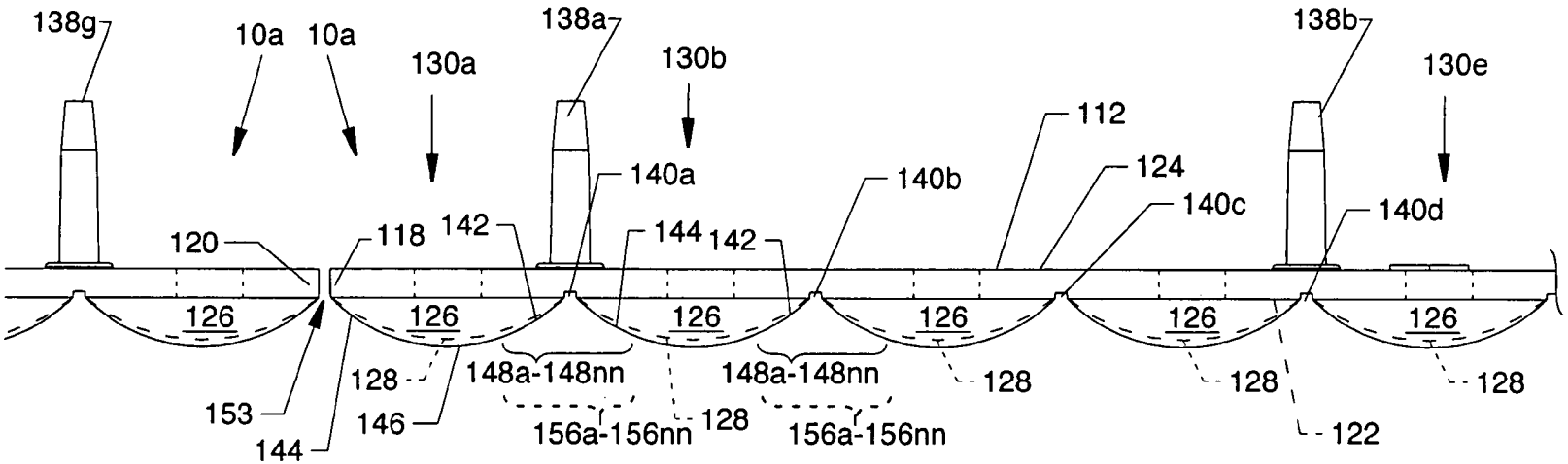
FIG. 11 is a top view of a section of the upper left corner of the louver panel shown in FIG. 10 juxtaposing a portion of an adjacent louver panel.
Figure 12:
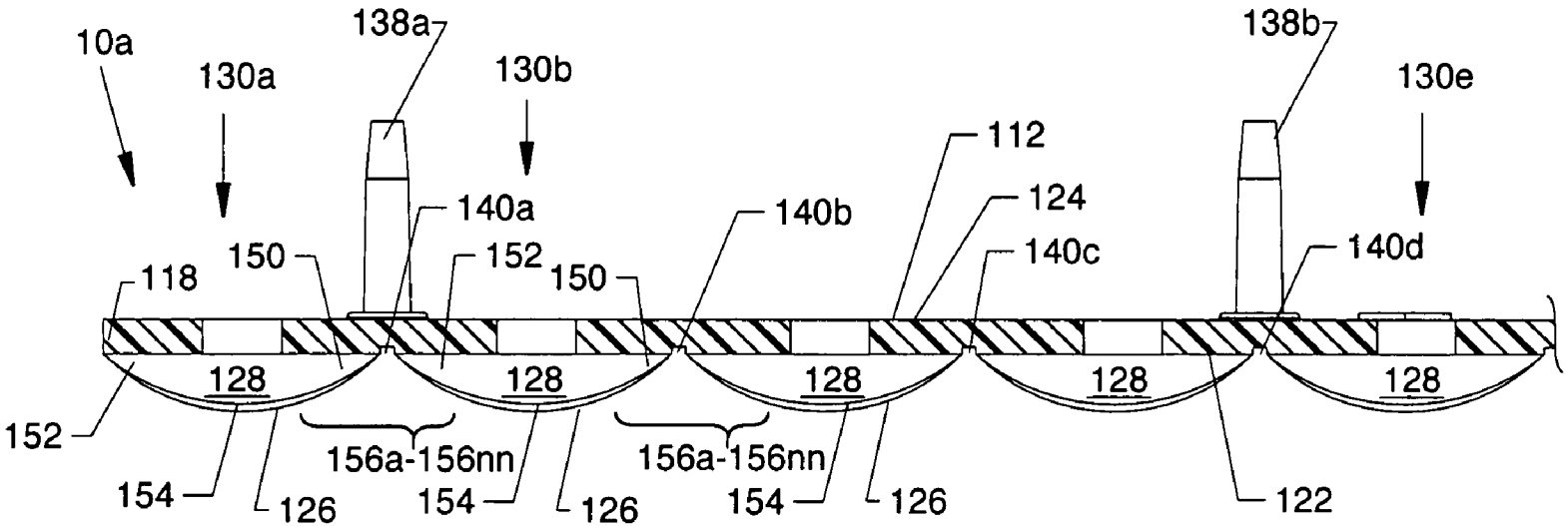
FIG. 12 is a top cross section view of the upper left corner of the louver panel along line 12-12 of FIG. 10.

FIG. 10 is an isometric view of a section of the upper left corner of the alternative louver panel for use with an electronic sign 10*a* showing the relationships, structure and arrangement of the primary louvers 126 and the secondary louvers 128, the holes 134*a*-134*nn*, the planar regions 136*a*-136*n* of the panel 112, and other directly associated features. FIG. 11 is a top view of a section of the upper left corner of the alternative louver panel 10*a* juxtaposing a portion of an adjacent alternative louver panel 10*a*. FIG. 12 is a top cross section view of the upper left corner of the louver panel 10*a* along line 12-12 of FIG. 10. The arrangement of the primary louvers 126, the secondary louvers 128, the holes 134*a*-134*nn*, and the interspersed planar regions 136*a*-136*n* benefits visuality in terms of increased contrast and LED viewability by providing shading for the LEDs extending through the holes 134*a*-134*nn*, as well as for the planar regions 136*a*-136*n* and associated various top and bottom surfaces of the primary louvers 126 and the secondary louvers 128 and the regions between the primary louvers 126 and the secondary louvers 128. Some primary louvers 126 extend outwardly from the panel 112 and are distanced from and spacingly positioned a short distance above some of the holes 134*a*-134*nn*. Other primary louvers 126 extend outwardly from the panel 112 and are positioned at the upper portion of each of the planar regions 136*a*-136*n*. Some secondary louvers 128 extend outwardly from the panel 112 and are spacingly positioned a short distance below each of the holes 134*a*-134*nn*. Other secondary louvers 128 extend outwardly from the panel 112 and are positioned at the lower portion of each of the planar regions 136*a*-136*n*. The width of the primary and of the secondary louvers 126 and 128, respectively, are the same, however, the depth of the primary and of the secondary louvers 126 and 128 differs, i.e., the primary louvers 126 extend outwardly a further distance from the panel 12 than the secondary louvers 128. Visual benefits are described in detail therein below with respect to FIGS. 13, 13*a*, 14 and 14*a*.

Furthermore, other visual benefits are derived from these and/or other features of the present invention in order to improve visual uniformity and regularity of visual perception whereby visible lines including vertically oriented lines and horizontally oriented lines formed between horizontally adjacent and vertically adjacent panels 112 are perceptively blended into a pattern and therefore pattern regularity is visually perceived by the sign observer.

Vertically oriented gaps formed by the close association of the left and right side edges 118 and 120, respectively, of horizontally adjacent louver panels 10*a* are associated with and visually blend with a plurality of vertically oriented grooves 140*a*-140*n* (FIGS. 8, 10 and 11) distributed and extending between the top edge 114 and the bottom edge 116 on the front surface 122 of panel 112. Features of the preferred embodiment, including the inner right edges 42 and inner left edges 44 and the front edge 46 of the adjacent rectangular shaped primary louvers 26, have been replaced by the arcuate primary louvers 126 having a continuous arcuate edge 146, and at the ends of the arcuate edge 146, co-located and contiguous arcuate end sections of the primary louver 126 bounded in part by inner right arcuate edges 142 and inner left arcuate edges 144 which meet and align with the plurality of grooves 140*a*-140*n*, thereby forming a plurality of viewing spaces 148*a*-148*nn* (FIG. 10) of a back-to-back arcuate nature between the adjacent primary louvers 126, whereby viewing of the grooves 140*a*-140*n* and a vertically oriented gap 153 (FIG. 11) between the louver panels 10*a* are observed by the viewer. The viewing spaces 148*a*-148*nn* (FIG. 10) are also distributed in columnar fashion in alignment between the columns 130*a*-130*n*. Additionally and in a like and similar fashion, features of the preferred embodiment, including the inner right edges 50, the inner left edges 52 and the front edge 54 of the rectangular shaped secondary louvers 28, have been replaced by the arcuate secondary louvers 128 having a continuous arcuate edge 154, and at the ends of the arcuate edge 154, co-located and contiguous arcuate end sections of the secondary louver 126 bounded in part by inner right arcuate edges 150 and inner left arcuate edges 152 which meet and align with the plurality of grooves 140*a*-140*n*, thereby forming a plurality of viewing spaces 156*a*-156*nn* of a back-to-back arcuate nature between adjacent secondary louvers 128, whereby viewing of the grooves 140*a*-140*n* and the gap 153 between the louvers panels 10*a* are seen by a distant viewer (FIG. 11). The viewing spaces 156*a*-156*nn* are also distributed in columnar fashion in alignment between the columns 130*a*-130*n*.

Figure 13:
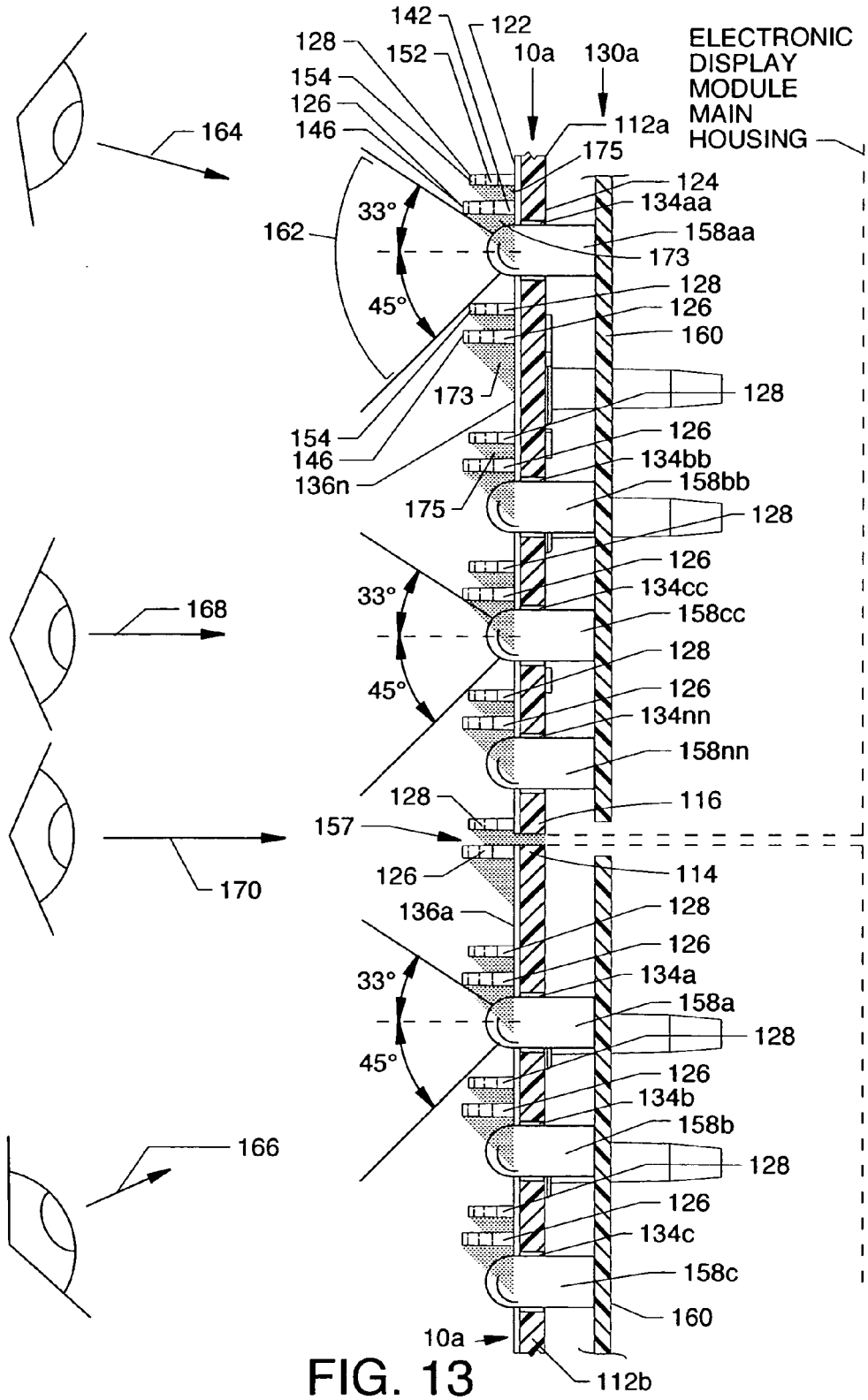
FIG. 13 shows some of the plurality of LEDs mounted to circuit boards and extending through some of the holes of vertically adjacent upper and lower panels and the associated shading with respect to interfering light sources which are generally located above and to the side of an electronic sign.

Referring now to FIG. 13, horizontally oriented gaps 157 formed by the close association of the top edges 114 and bottom edges 116, respectively, of vertically adjacent louver panels 10*a* are also blended by the alignment in close proximity of the top edges 114 and bottom edges 116 of such louver panels 10*a*. The primary louver 126 in the top LED row 132*a* of a lower louver panel 10*a* is directly below where a horizontal module splice across a gap 157 will occur with an upper louver panel 10*a* where the secondary louver 128 in the bottom LED row 132*nn* of an upper louver panel 10*a* is directly above where a horizontal louver panel 10*a* splice will occur. The gap 157 between the upper and lower louver panels 10*a* occurring at a horizontal module splice is the same distance between the other closely spaced primary and secondary louvers 126 and 128, respectively. Consider the vertically adjacent alignment of an upper panel 112*a* and a lower panel 112*b* of vertically adjacent louver panels 10*a* as also shown in FIG. 13. The bottom secondary louver 128 of the upper louver panel 10*a* is closely but spacingly aligned with the top primary louver 126 of the lower louver panel 10*a* where such spaced alignment presents the visual effect of closely resembling that of the vertical spacing of the closely associated top and bottom edges 114 and 116, respectively, of the primary louvers 126 and the secondary louvers 128, such as in each of the rows 132*b*-132*i* (FIG. 10), for example. This relationship helps to shade the horizontal electronic module splice (gap 157) between electronic display modules and prevents the "tiling" effect present in some electronic sign products.

Figure 14:
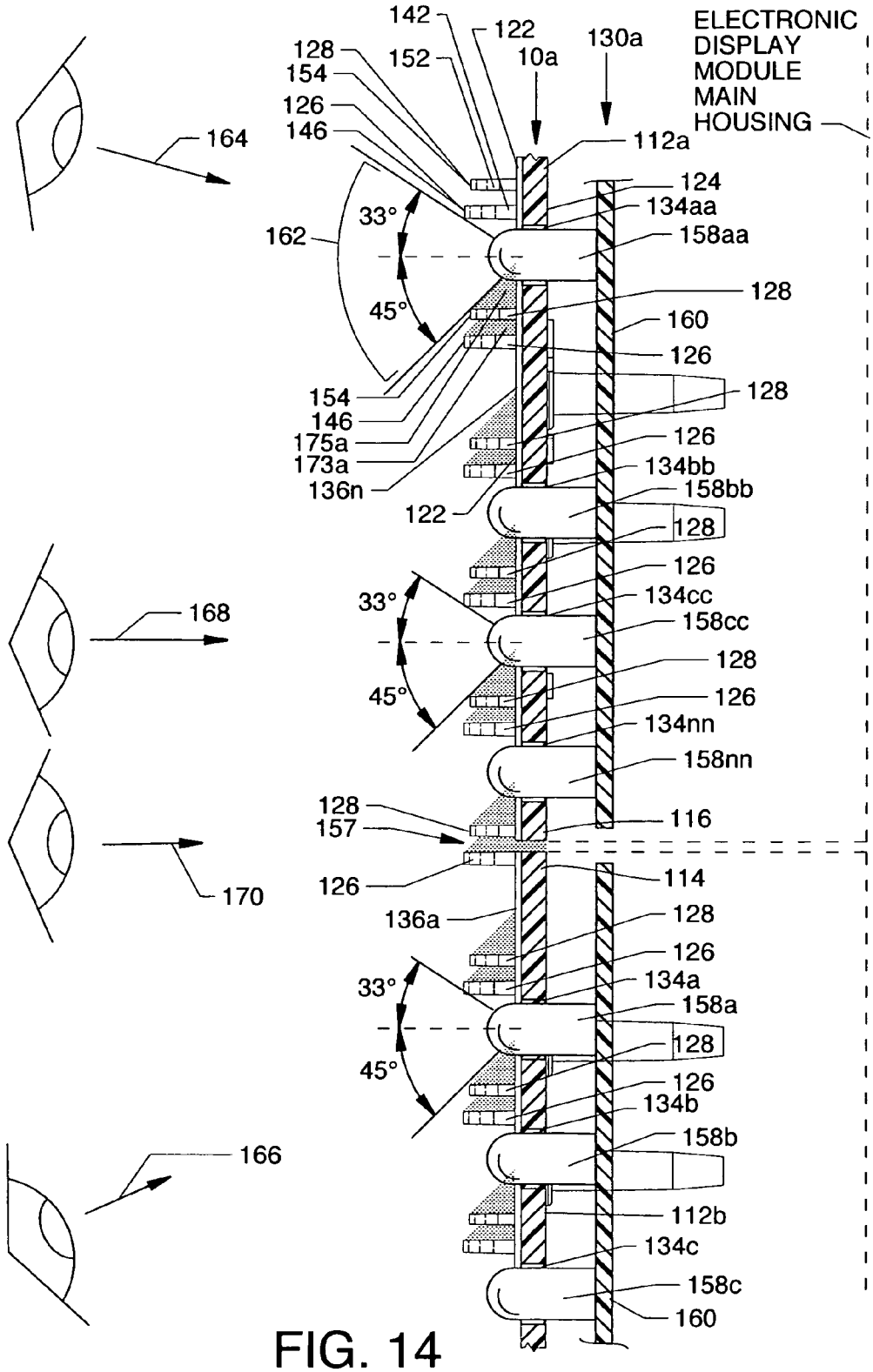
FIG. 14 shows some of the plurality of LEDs mounted to circuit boards and extending through some of the holes of vertically adjacent upper and lower panels and the associated shading with respect to interfering light sources which are generally located below and to the side of an electronic sign.

As previously mentioned, the arrangement of the primary louvers 126, the secondary louvers 128, the holes 134*a*-134*nn*, and the interspersed planar regions 136*a*-136*n* benefit visuality in terms of increased contrast and LED viewability by providing shading for LEDs extending through the holes 134*a*-134*nn*, shading for the front surface 122 surrounding the holes 134*a*-134*nn*, shading for the planar regions 136*a*-136*n*, shading for the associated various top and bottom surfaces of the primary louvers 126 and the secondary louvers 128, and shading for the major and minor regions of the front surface 122 between the primary louvers 126 and the secondary louvers 128. FIGS. 13 and 14 illustrate the benefits pertaining to use of the present invention including improved visuality in terms of increased contrast and LED viewability by providing unique shading for the LEDs and other components or regions of an electronic sign.

FIGS. 13 and 14 show some of the plurality of LEDs 158*a*-158*nn* mounted to circuit boards 160 and extending through some of the holes 134*a*-134*nn* of vertically adjacent upper and lower panels 112 herein designated as upper and lower panels 112*a* and 112*b*, respectively. Preferably, the LEDs 158*a*-158*nn* are interleaved, such as in referenced application Ser. No. 11/786,720. With respect to viewing along the vertical aspect, the primary louvers 126 in conjunction with features of the LEDs 158*a*-158*nn* provide angular viewing windows 162 for viewing of the LEDs 158*a*-158*nn*. Viewing of the LEDs 158*a*-158*nn* through and as determined by the viewing windows 162 can be accomplished in front of and in perpendicular alignment to the LEDs 58*a*-58*nn* or viewing can be accomplished to the side of and in offset angular alignment to the left or right of the LEDs 58*a*-58*nn* where, in all cases, the arcuate edges 146 and 154, including the inner right arcuate edges 142, the inner left arcuate edge 144, the inner right arcuate edges 150, and the inner left arcuate edge 152 of the primary and secondary louvers 126 and 128, respectively, determine the angular boundary for viewing. An upward viewing angle of the angular viewing window 162 is bounded by the angle between on the longitudinal axis of the LED at the LED focal center and the lower portion of the edge 146 of the primary louver 126, shown for purposes of example, as 33° in combination with a downward viewing angle of the angular viewing window 162 which is bounded by the angle between on the longitudinal axis of the LED at the LED focal center and the upper portion of the edge 154 of a secondary louver 128 distanced below the first primary louver 126, shown for purposes of example as 45° as illustrated.

Figure 13A:
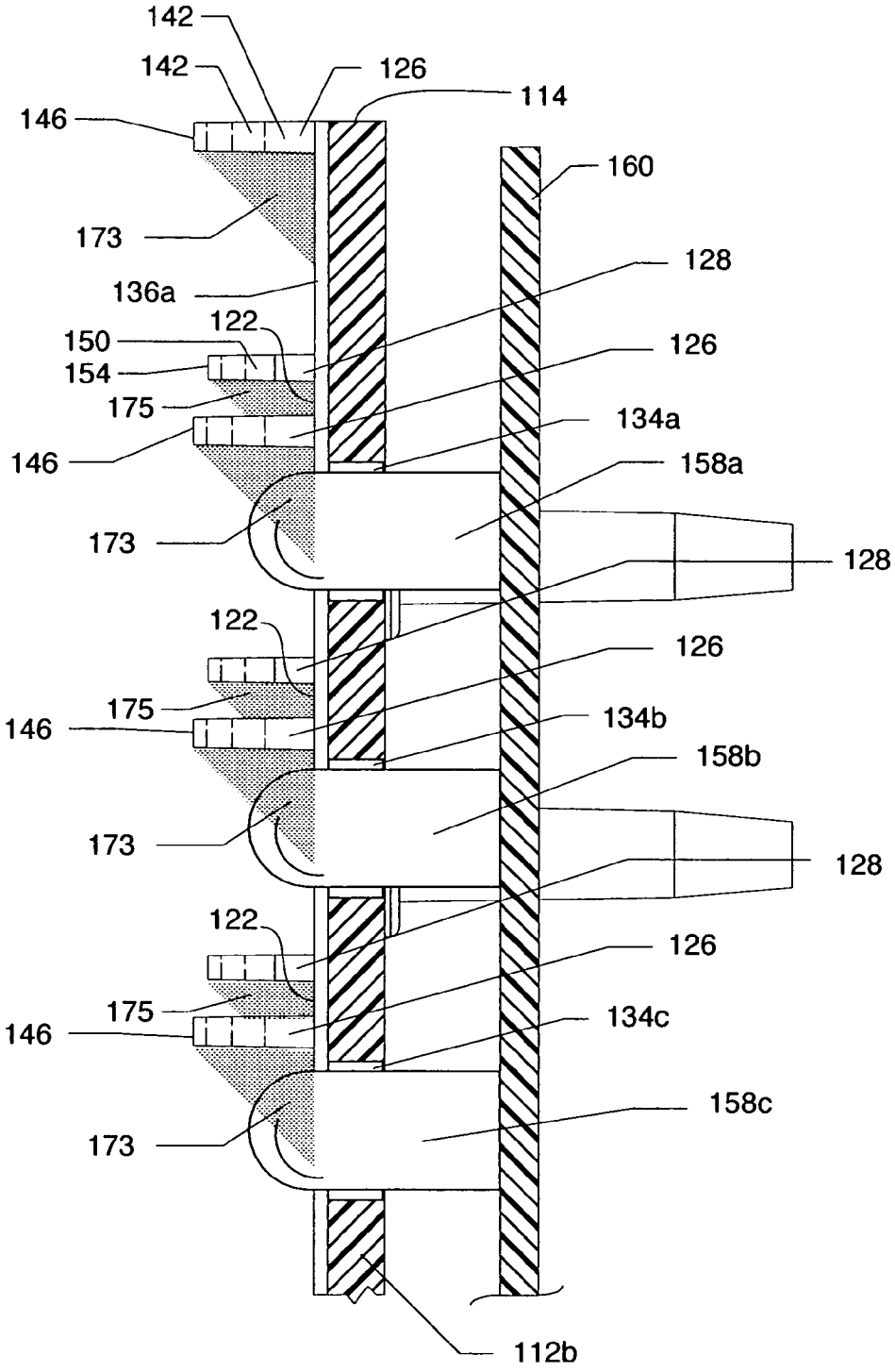
FIG. 13*a* is a detailed view of the lower portion of FIG. 13.
Figure 14A:
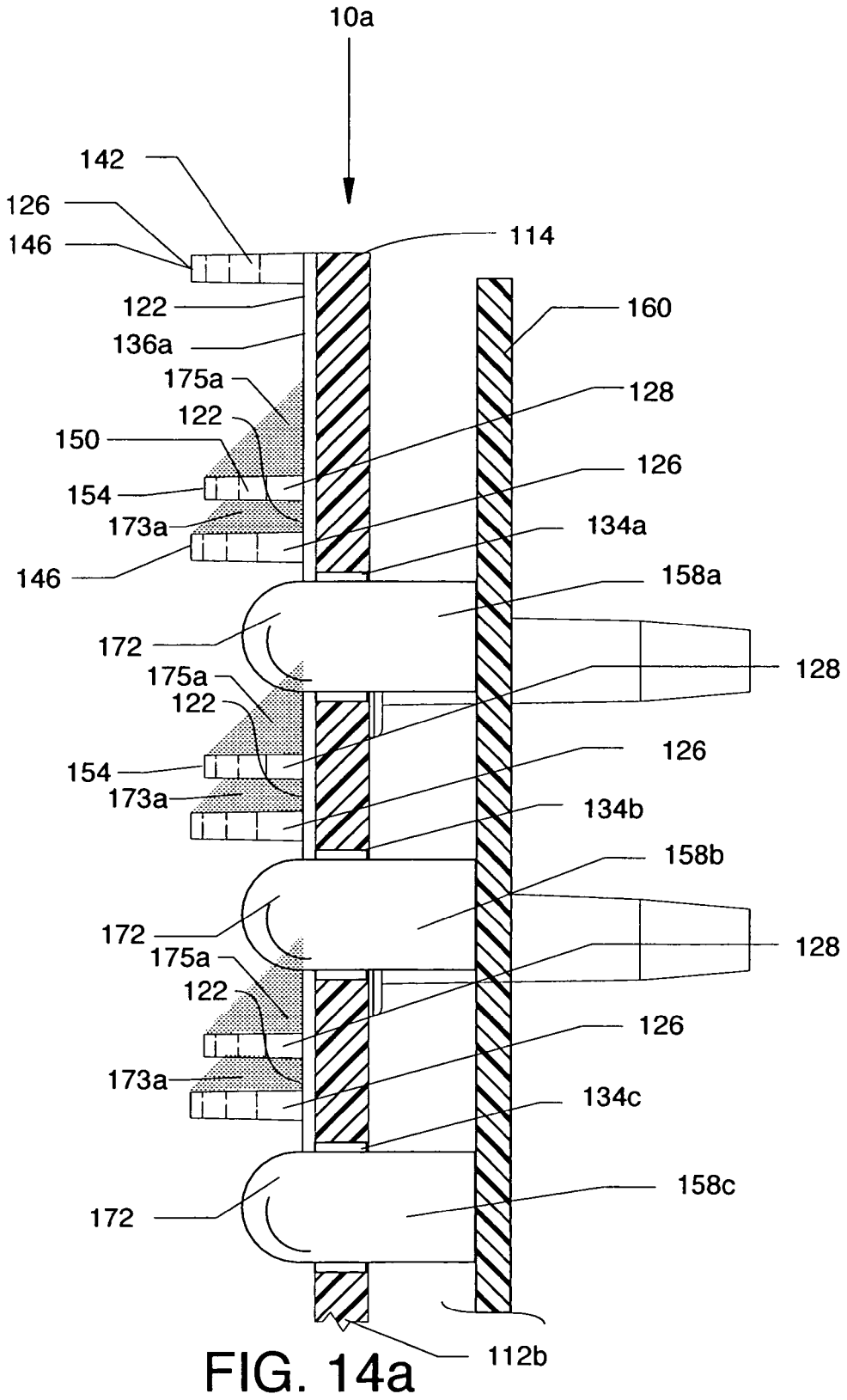
FIG. 14*a* is a detailed view of the lower portion of FIG. 14.

Furthermore, with respect to shading, FIGS. 13 and 13*a* show an example of shading with respect to interfering light sources which are generally located above and in front of an electronic sign having upper and lower panels 112*a* and 112*b*, and FIGS. 14 and 14*a* show shading with respect to interfering light sources which are generally located below and to the side of an electronic sign having upper and lower panels 112*a* and 112*b*. Various observer viewing situations are shown in each of the FIGS. 13 and 14, including an upward viewing position 164 where the viewer is generally located upward and above the structure of the upper and lower panels 112*a* and 112*b*, a downward viewing position 166 where the viewer is generally located below the structure of the upper and lower panels 112*a* and 112*b*, a straight-on viewing position 168 where the viewer is generally located at the same level of the upper and lower panels 112*a* and 112*b*, and a straight on edge viewing position 170 where the viewer is generally afforded a view of the gap 157 between the bottom secondary louvers 128 of the upper panel 112*a* and the top primary louvers 126 of the lower panel 112*b*. Shading, beneficial in terms of increased contrast and LED visibility, are viewed from any of the viewing positions.

Shadings, which can be in the form of shadows as shown in FIG. 13 and as shown in greater detail in FIG. 13*a*, are shown with respect to an interfering light source which is generally above and in the front of an electronic sign having upper and lower panels 112*a* and 112*b* of the present invention. FIG. 13*a* is a detailed view of the upper portion of the panel 112*b* and associated structures shown in FIG. 13. Shadings are formed by blocking direct or ambient light by the primary and secondary louvers 126 and 128, respectively. For example, in FIG. 13*a:*

1. Primary shadings 173 are formed by and located on the under surface of the primary louvers 126 and project upon and/or influence the greater portion of the front surface 122 of the panel 112*b* between the widely spaced upper primary louvers 126 and the lower secondary louvers 128, as shown. If the light source is positioned horizontally closer to the plane of the panel 112*b*, the primary shading 173 would also increasingly cover the front surface 122 and the top surface of the underlying secondary louver 128. LEDs 158*a*-158*nn* which project through the holes 134*a*-134*nn* of the panel 112*b* are masked and/or beneficially influenced by the respective primary shadings 173.
2. Secondary shadings 175 are formed by and located on the under surface of the secondary louvers 128 and project upon and/or influence a portion of the front surface 122 of the panels 112*b* between closely spaced upper secondary louvers 128 and lower primary louvers 126 and also project upon and/or influence an inward portion of the top surface of the primary louvers 126, as shown. If the light source is positioned horizontally closer to the plane of the panel 112*b*, the secondary shading 175 could also cover a greater portion of the top surface of an underlying primary louver 126.

Provision of the secondary louvers 128 in combination with primary louvers 126 is of great and significant benefit for improving the visibility and contrast of an electronic sign by using the present invention, especially where shading protection is provided for an interfering light source above and in front of an electronic sign by using the louvers panels of the present invention. The use of the secondary louvers 128 adds a region of viewable secondary shading 175 which is complimentary to the viewable primary shading 173 provided by the primary louver 126. The various observer viewing positions shown in FIG. 13 provide for viewing combinations of primary and secondary shadings 173 and 175 with respect to the upper and lower surfaces of the primary louvers 126 and the secondary louvers 128, the major and minor regions of the front surfaces 122 between such louvers, and the LEDs 158*a*-158*nn.*

Although shading is described for multiple panels 112*a* and 112*b*, the effects of shading are the same using multiple panels 112 except, of course, a single panel 112 may not necessarily be considered for the purpose of hiding or blending of edges.

Shadings, which can be in the form of shadows in FIG. 14 and as shown in greater detail in FIG. 14*a*, are shown with respect to an interfering light source which is generally below and to the front of an electronic sign having upper and lower panels 112*a* and 112*b* of the present invention. FIG. 14*a* is a detailed view of the upper portion of the panel 112*b* and associated structures shown in FIG. 14. Shadings are formed by blocking direct or ambient light by the primary and secondary louvers 126 and 128, respectively. For example, in FIG. 14*a*, primary shadings 173*a* are formed by and located on the top surface of the primary louvers 26 and project upon and/or influence the minor portion of the front surfaces 122 of the panel 112*b* between the closely spaced upper secondary louvers 128 and the lower primary louvers 126 and on a greater portion of the bottom surface of the secondary louvers 128. Secondary shadings 175*a* are formed by and located on the top surfaces of the secondary louvers 128 and project upon and/or beneficially influence the major portion of the front surface 122 of the panels 112*b* between the widely spaced upper primary louvers 126 and lower secondary louvers 128. A portion of the LEDs 158*a*-158*nn* which project through the holes 134*a*-134*nn* of the panel 112*b* are also masked and/or beneficially influenced by the secondary shadings 175*a*, as shown. If the light source is positioned horizontally closer to the plane of the panel 112*b*, the secondary shading 175*a* would also cover a greater portion of the front surface 122 between a widely spaced lower secondary louver 128 and an upper primary louver 126 and would provide greater shading of the LEDs 158*a*-158*nn*.

Provision of the secondary louvers 128 in combination with primary louvers 126 is of great and significant benefit for improving the visibility and contrast of an electronic sign using the present invention especially where shading protection is provided below and to the side of an electronic sign using the louver panels 10*a* of the present invention, wherein the use of the secondary louvers 128 adds a region of viewable primary shading 175*a* which is complimentary to the viewable secondary shading 173*a* provided by the primary louver 126. The various observer viewing positions 164-166 shown in FIG. 14 provide for viewing of the primary and secondary shadings 173*a* and 175*a* with respect to the upper and lower surfaces of the primary louvers 126 and the secondary louvers 128, the major and minor regions of the front surfaces 122 between such louvers, and the LEDs 158*a*-158*nn*.

Although shading is described for multiple panels 112*a* and 112*b*, the effects of shading are the same using multiple panels 112, except, of course, a single panel 112 may not necessarily be considered for the purpose of hiding or blending of edges.

Although vertical viewability, such as that described with respect to the angular viewing window 162, has been described, the present invention also provides for an improved horizontal viewing for use with widely spaced interleaved pixel spacing, such as described in the previously referenced parent patent application Ser. No. 11/786,720 and in the continuation-in-part (CIP) patent application, entitled "Pixel Interleaving Configuration for Use in High Definition Electronic Sign Displays", application number to be assigned and being filed concurrently herewith. As the orientation of horizontally adjacent primary louvers 126 and the horizontally adjacent secondary louvers 128 lie in different horizontally oriented planes, there is no horizontal viewing restriction caused by the use of the primary louvers 126 and the secondary louvers 128.

Figure 15:
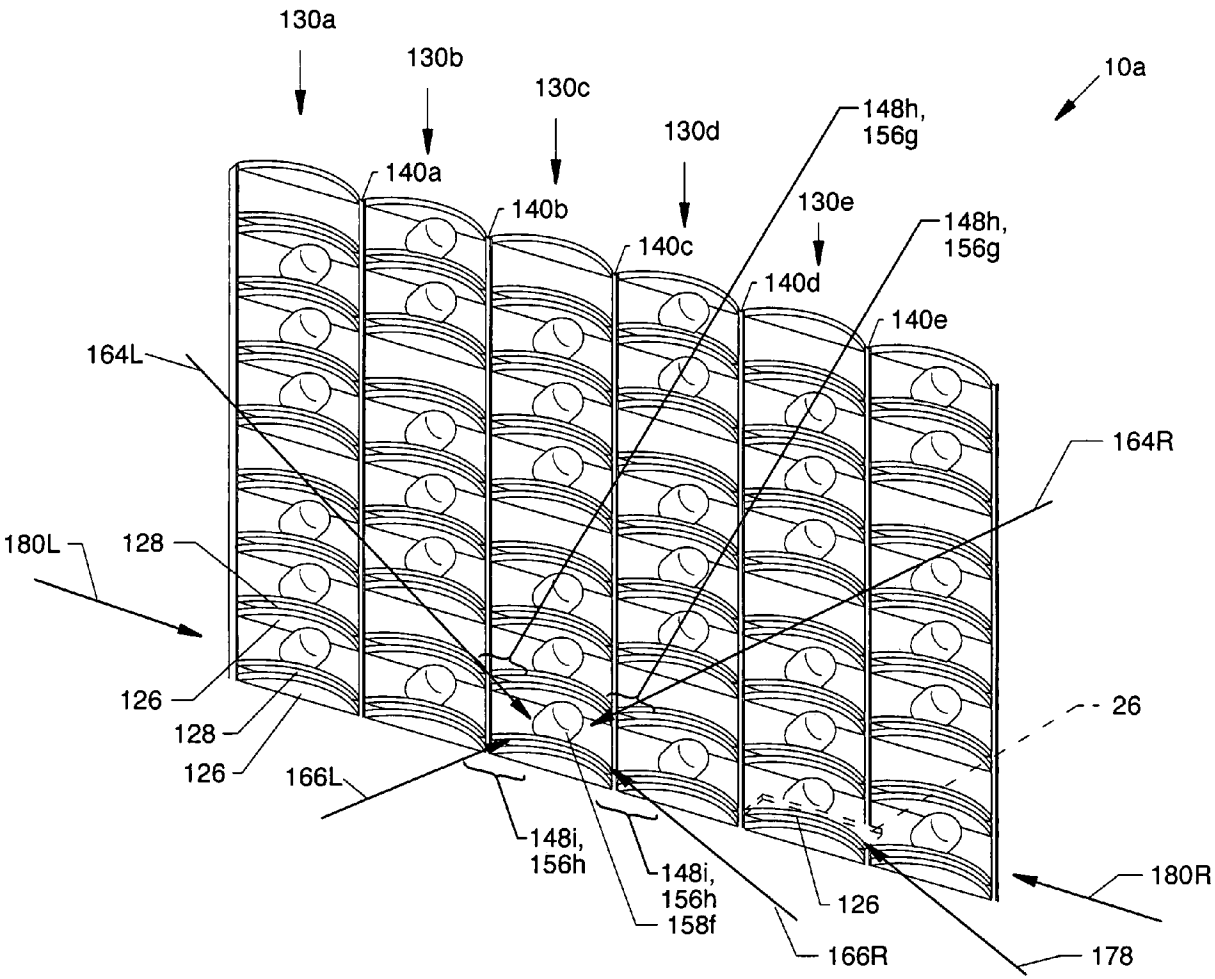
FIG. 15 is an isometric view showing a section of the upper left corner of the louver panel shown in FIG. 10 for use with an electronic sign showing various viewing positions for viewing of an LED.

Previous reference to vertical viewing in FIG. 13 addressed angular viewing windows 162 for viewing of the LEDs 158*a*-158*nn*, wherein perpendicular alignment to the LEDs 58*a*-58*nn* or viewing at an offset angular alignment to the left or right of the LEDs 58*a*-58*nn* as determined by the arcuate edges 146 and 154 of the primary and secondary louvers 126 and 128, respectively. Additional benefits are provided by using the arcuate louver structure as shown in FIG. 15, which is an isometric view showing a section of the upper left corner of the louver panel for use with an electronic sign 10*a*. FIG. 15 is an example showing various viewing positions or angles for viewing LED 158*f* of the plurality of LEDs 158*a*-158*n* in column 130*c* through multiple viewing spaces 148*h* and 156*g*, as well as multiple viewing spaces 148*i* and 156*h* located between columns 130*b* and 130*c* and between columns 130*c* and 130*d*, respectively. For example, viewing of the LED 158*f* from a left offset upward viewing position 164L (refer to FIG. 13) is accomplished through the viewing spaces 148*h* and 156*g* located between columns 130*b* and 130*c*. Correspondingly, viewing of the LED 158*f* from a left offset downward viewing position 166L is accomplished through the viewing spaces 148*i* and 156*h* located between columns 130*b* and 130*c*. Viewing of the LED 158*f* from a right offset upward viewing position 164R is accomplished through the viewing spaces 148*h* and 156*g* located between columns 130*c* and 130*d*. Viewing of the LED 158*f* from a right offset downward viewing position 166R is accomplished through the viewing spaces 148*i* and 156*h* located between columns 130*c* and 130*d*. The use of the arcuate louver structure provides additional and greater viewing capabilities from different viewing positions when compared to using rectangular louver structure as shown by a rectangular primary louver 26 superimposed over an arcuate primary louver 126 shown in dashed lines. Viewing such through viewing spaces 148*i* and 156*h* in column 130*e* would be restricted such as represented by the blocked view arrow 178. Viewing of the LED 158*f* from a left horizontal viewing position 180L and from a right horizontal viewing position 180R are generally unrestricted by the primary louvers 126 or the secondary louvers 128. The horizontal spacing provided by the interleaving of the LEDs 158*a*-158*n* provides for a horizontally oriented unrestricted viewing window of 140°, i.e., 70° each side of center of the LEDs 158*a*-158*n*.

Various modifications can be made to the present invention without departing from the apparent scope thereof.

It is claimed:

1. A louver panel for an electronic sign comprising:

an expansive planar panel having:

a top edge and an opposite bottom edge;

a left side edge and an opposite right side edge; and a front surface and a rear surface;

a plurality of rectangular shaped primary louvers extending perpendicularly from said front surface of said planar panel, said plurality of primary louvers being arranged in columns and rows with a primary louver gap formed between primary louvers in adjacent columns;

a plurality of rectangular shaped secondary louvers extending perpendicularly from said front surface of said planar panel, said plurality of rectangular shaped secondary louvers being arranged in said columns and rows with a secondary louver gap formed between secondary louvers in adjacent columns, each of said secondary louvers being spaced below a respective primary louver in each of said columns, said primary louvers and said secondary louvers having the same longitudinal widths, each of said secondary louvers having a smaller depth than each of said primary louvers; and, a plurality of spaced holes through said planar panel, said plurality of spaced holes being arranged in said columns and rows in a patterned array, and each of said holes in said patterned array being vertically sandwiched and spaced between an adjacent pair of said primary and secondary louvers;

wherein a vertical, elongated groove extends between successive adjacent columns from said top edge of said planar panel to said bottom edge of said planar panel, said elongated groove being inset into said front surface of said planar panel and vertically aligned with a plurality of the primary louver gaps and a plurality of the secondary louver gaps.

2. The louver panel of claim 1, wherein each of said elongated grooves has a width equal to a spacing separating said primary and secondary louvers in one column from said primary and secondary louvers in a successive adjacent column.

3. The louver panel of claim 2, wherein each of said columns has a primary louver at said top edge of said planar panel and a secondary louver at said bottom edge of said planar panel.

4. The louver panel of claim 1, wherein said rear surface of said expansive planar panel has a plurality of spaced pins affixed to and extending therefrom.

5. The louver panel of claim 4, wherein said electronic sign includes a circuit board supported adjacent said rear surface of said planar panel, said circuit board supporting a plurality of light sources which extend through said triplets of holes in said planar panel.

6. The louver panel of claim 5, wherein said light sources are LEDs.

7. The louver panel of claim 6, wherein said spaced pins extend through said circuit board and support said planar panel.

8. The louver panel of claim 6, wherein said louver panel, said circuit board, and said LEDs form an electronic display module supported within a main housing.

9. The louver panel of claim 6, wherein said LEDs in each of said triplets of holes includes a red LED, a blue LED and a green LED.

10. The louver panel of claim 1, wherein said holes in each of said columns being primarily arranged in triplets with each of said triplets being adjacently spaced from each other.

11. The louver panel of claim 10, wherein said triplets in one column are interleaved with said triplets in an adjacent column.

12. The louver panel of claim 1, wherein said electronic sign includes a circuit board supported adjacent said rear surface of said planar panel, said circuit board supporting a plurality of light sources which extend through said holes in said planar panel.

13. The louver panel of claim 12, wherein said light sources are LEDs.

14. The louver panel of claim 13, wherein said louver panel, said circuit board, and said LEDs form an electronic display module supported within a main housing.

15. A louver panel for an electronic sign comprising:

an expansive planar panel having:

a top edge and an opposite bottom edge;

a left side edge and an opposite right side edge; and a front surface and a rear surface;

a plurality of arcuate shaped primary louvers extending perpendicularly from said front surface of said planar panel, said plurality of primary louvers being arranged in columns and rows with a primary louver gap formed between primary louvers in adjacent columns;

a plurality of arcuate shaped secondary louvers extending perpendicularly from said front surface of said planar panel, said plurality of arcuate shaped secondary louvers being arranged in said columns and rows with a secondary louver gap formed between secondary louvers in adjacent columns, each of said secondary louvers being spaced below a respective primary louver in each of said columns, each of said arcuate shaped primary louvers having a longitudinal base width equal to the longitudinal base width of each of said arcuate shaped secondary louvers, each of said secondary louvers having a smaller depth at its apex than the apex of each of said primary louvers; and, a plurality of spaced holes through said planar panel, said plurality of spaced holes being arranged in said columns and rows in a patterned array, and each of said holes in said patterned array being vertically sandwiched and spaced between an adjacent pair of said primary and secondary louvers;

wherein a vertical, elongated groove extends between successive adjacent columns from said to edge of said planar panel to said bottom edge of said planar panel, said elongated groove being inset into said front surface of said planar panel and vertically aligned with a plurality of the primary louver gaps and a plurality of the secondary louver gaps.

16. The louver panel of claim 15, wherein each of said elongated grooves has a width equal to a spacing separating said primary and secondary louvers in one column from said primary and secondary louvers in a successive adjacent column.

17. The louver panel of claim 16, wherein each of said columns has a primary louver at said top edge of said planar panel and a secondary louver at said bottom edge of said planar panel.

18. The louver panel of claim 15, wherein said holes in each of said columns being primarily arranged in triplets with each of said triplets being adjacently spaced from each other.

19. The louver panel of claim 18, wherein said triplets in one column are interleaved with said triplets in an adjacent column.

20. The louver panel of claim 19, wherein said electronic sign includes a circuit board supported adjacent said rear surface of said planar panel, said circuit board supporting a plurality of light sources which extend through said triplets of holes in said planar panel.

21. The louver panel of claim 20, wherein said light sources are LEDs.

22. The louver panel of claim 21, wherein said LEDs in each of said triplets of holes includes a red LED, a blue LED and a green LED.

23. An electronic sign comprising:

a plurality of louver panels arranged in a horizontal and vertical array wherein horizontally adjacent louver panels are separated by a small gap and wherein vertically adjoining louver panels are separated by a small gap, each of said plurality of louver panels comprising an expansive planar panel having a top edge, an opposite bottom edge, a left side edge and an opposite right side edge, a front surface and a rear surface;

a plurality of rectangular shaped primary louvers extending perpendicularly from said front surface of said planar panel, said plurality of primary louvers being arranged in columns and rows with a primary louver gap formed between primary louvers in adjacent columns;

a plurality of rectangular shaped secondary louvers extending perpendicularly from said front surface of said planar panel, said plurality of rectangular shaped secondary louvers being arranged in said columns and rows with a secondary louver gap formed between secondary louvers in adjacent columns, each of said secondary louvers being spaced a first distance below an upper adjacent primary louver in each of said columns and being spaced a second smaller distance above a lower adjacent primary louver in each of said columns, said primary louvers and said secondary louvers having the same longitudinal widths, each of said secondary louvers having a smaller depth than each of said primary louvers, each of said columns has a primary louver at said top edge of said planar panel and a secondary louver at said bottom edge of said planar panel; and, a plurality of spaced holes through said planar panel, said plurality of spaced holes being arranged in said columns and rows in a patterned array, and each of said holes in said patterned array being vertically sandwiched and spaced between an adjacent pair of said primary and secondary louvers;

wherein a vertical, elongated groove extends between successive adjacent columns from said top edge of said planar panel to said bottom edge of said planar panel, said elongated groove being inset into said front surface of said planar panel and vertically aligned with a plurality of the primary louver gaps and a plurality of the secondary louver gaps.

24. The electronic sign of claim 23, wherein each of said elongated grooves has a width equal to a spacing separating said primary and secondary louvers in one column from said primary and secondary louvers in a successive adjacent column.

25. The electronic sign of claim 24, wherein said small gap separating said horizontally adjacent louver panels is equal to said width of said elongated groove.

26. The electronic sign of claim 25, wherein said small gap separating said vertically adjacent louver panels is equal to said second smaller distance.

27. The electronic sign of claim 26, wherein said holes in each of said columns being primarily arranged in triplets with each of said triplets being adjacently spaced from each other.

28. The electronic sign of claim 27, wherein said triplets in one column are interleaved with said triplets in an adjacent column.

29. The electronic sign of claim 28, wherein said electronic sign includes a circuit board supported adjacent said rear surface of said planar panel, said circuit board supporting a plurality of light sources which extend through said triplets of holes in said planar panel.

30. The electronic sign of claim 29, wherein said light sources are LEDs.

31. The electronic sign of claim 30, wherein said LEDs in each of said triplets of holes includes a red LED, a blue LED and a green LED.

32. An electronic sign comprising:

a plurality of louver panels arranged in a horizontal and vertical array wherein horizontally adjacent louver panels are separated by a small gap and wherein vertically adjoining louver panels are separated by a small gap, each of said plurality of louver panels comprising an expansive planar panel having a top edge, an opposite bottom edge, a left side edge and an opposite right side edge, a front surface and a rear surface;

a plurality of arcuate shaped primary louvers extending perpendicularly from said front surface of said planar panel, said plurality of primary louvers being arranged in columns and rows with primary louver gap formed between primary louvers in adjacent columns;

a plurality of arcuate shaped secondary louvers extending perpendicularly from said front surface of said planar panel, said plurality of arcuate shaped secondary louvers being arranged in said columns and rows with a secondary louver gap formed between secondary louvers in adjacent columns, each of said secondary louvers being spaced a first distance below an upper adjacent primary louver in each of said columns and being spaced a second smaller distance above a lower adjacent primary louver in each of said columns, each of said arcuate shaped primary louvers having a longitudinal base width equal to the longitudinal base width of each of said arcuate shaped secondary louvers, each of said secondary louvers having a smaller depth at its apex than the apex of each of said primary louvers, each of said columns has a primary louver at said top edge of said planar panel and a secondary louver at said bottom edge of said planar panel; and, a plurality of spaced holes through said planar panel, said plurality of spaced holes being arranged in said columns and rows in a patterned array, and each of said holes in said patterned array being vertically sandwiched and spaced between an adjacent pair of said primary and secondary louvers;

wherein a vertical, elongated groove extends between successive adjacent columns from said top edge of said planar panel to said bottom edge of said planar panel, said elongated groove being inset into said front surface of said planar panel and vertically aligned with a plurality of the primary louver gaps and a plurality of the secondary louver gaps.

33. The electronic sign of claim 32, wherein each of said elongated grooves has a width equal to a spacing separating said primary and secondary louvers in one column from said primary and secondary louvers in a successive adjacent column.

34. The electronic sign of claim 33, wherein said small gap separating said horizontally adjacent louver panels is equal to said width of said elongated groove.

35. The electronic sign of claim 34, wherein said small gap separating said vertically adjacent louver panels is equal to said second smaller distance.

36. The electronic sign of claim 35, wherein said holes in each of said columns being primarily arranged in triplets with each of said triplets being adjacently spaced from each other.

37. The electronic sign of claim 36, wherein said triplets in one column are interleaved with said triplets in an adjacent column.

38. The electronic sign of claim 37, wherein said electronic sign includes a circuit board supported adjacent said rear surface of said planar panel, said circuit board supporting a plurality of light sources which extend through said triplets of holes in said planar panel.

39. The electronic sign of claim 38, wherein said light sources are LEDs.

40. The electronic sign of claim 39, wherein said LEDs in each of said triplets of holes includes a red LED, a blue LED, and a green LED.

* * * * *